US007534215B2

(12) United States Patent
Saringer

(10) Patent No.: US 7,534,215 B2
(45) **Date of Patent: *May 19, 2009**

(54) MECHANISM FOR GENERATING WAVE MOTION

(75) Inventor: John H. Saringer, Stouffville (CA)

(73) Assignee: Somawave Inc., Stouffville (CA)

( * ) Notice: Subject to any disclaimer, the term of this patent is extended or adjusted under 35 U.S.C. 154(b) by 812 days.

This patent is subject to a terminal disclaimer.

(21) Appl. No.: 10/773,458

(22) Filed: Feb. 9, 2004

(65) Prior Publication Data

US 2004/0215113 A1 Oct. 28, 2004

Related U.S. Application Data

(63) Continuation-in-part of application No. 09/922,959, filed on Aug. 7, 2001, now Pat. No. 6,689,076, which is a continuation-in-part of application No. 09/443,459, filed on Nov. 19, 1999, now Pat. No. 6,269,500, which is a continuation-in-part of application No. 09/121,185, filed on Jul. 23, 1998, now Pat. No. 6,029,294.

(51) Int. Cl.
*A61H 7/00* (2006.01)

(52) U.S. Cl. ..... 601/90; 601/95; 601/98; 601/103

(58) Field of Classification Search ..... 601/49, 601/51, 53, 61, 89–93; 5/600, 610, 915; 440/16

See application file for complete search history.

(56) References Cited

U.S. PATENT DOCUMENTS 4,979,502 A * 12/1990 Hunt ..... 601/15
4,999,861 A * 3/1991 Huang ..... 5/600
5,109,558 A * 5/1992 Di Blasi ..... 5/611
5,626,555 A * 5/1997 Di Blasi et al. ..... 601/98
5,708,996 A * 1/1998 Marenco ..... 5/613
6,029,294 A * 2/2000 Saringer ..... 5/600
6,269,500 B1 * 8/2001 Saringer ..... 5/600

* cited by examiner

*Primary Examiner*—Michael A. Brown
(74) *Attorney, Agent, or Firm*—Lynn C. Schumacher; Hill & Schumacher

(57) ABSTRACT

The present invention provides a wave generating apparatus for generating waves in for example beds, chairs and the like. The apparatus can be constructed to include a motor and crank assembly connected to a flexible sheet and a stationary inertial member. In one aspect of the invention there is provided an apparatus for generating wave motion, comprising a flexible member; an oscillatory drive means attached to said flexible member, said oscillatory drive means including a crank assembly having an axis of rotation; at least two link members each having opposed first and second end portions, the at least two link members being spaced apart a first preselected distance from each other and each being rigidly attached at their respective first end portions to said flexible member; and at least one elongate beam, said at least two link members being pivotally attached to the at least one elongate beam, and the elongate beam being attached to the crank assembly, for imparting oscillatory motion to the at least one elongate beam so that when the oscillatory drive means is engaged the at least one elongate beam undergoes oscillatory motion which produces transverse waves along the flexible member.

33 Claims, 32 Drawing Sheets

MECHANISM FOR GENERATING WAVE MOTION

CROSS REFERENCE TO RELATED U.S APPLICATIONS

This patent application is a continuation-in-part application of U.S. patent application Ser. No. 09/922,959 filed on Aug. 7, 2001, which has now been allowed, which is a continuation-in-part application of U.S. patent application Ser. No. 09/443,459 filed on Nov. 19, 1999, entitled MECHANISM FOR GENERATING WAVE MOTION, which has now issued to U.S. Pat. No. 6,269,500, which is a continuation-in-part application of U.S. patent application Ser. No. 09/121,185 filed on Jul. 23, 1998, entitled MECHANISM FOR GENERATING WAVE MOTION which has now issued to U.S. Pat. No. 6,029,294, all of the above applications and Letters Patents being incorporated herein by reference in their entirety.

FIELD OF THE INVENTION

The present invention relates to a mechanism for generating wave motion, and more particularly the invention relates to beds, chairs and other surfaces in contact with the human body having wave generating mechanisms incorporated therein.

BACKGROUND OF THE INVENTION

Patients who are immobilized due to partial or complete paralysis, or are recuperating from major surgery or otherwise bedridden for extended periods of time, or passengers in vehicles or office workers immobilized in chairs are often unable to exercise or move sufficiently under their own power. In many cases this is problematic and can lead to complications such as thrombosis or bed sores, and disuse atrophy of joints and soft tissues. Most solutions to this problem involve changing pressure points exerted on the patient's body by the bed or couch on which they are supported. Mattresses having fluidized beds incorporated into the structure or inflatable/deflatable devices are common but these units typically involve complicated mechanisms and circuitry and are quite expensive. A propagating wave through a body support is a desirable alternative to these other solutions.

Several types of wave generating devices have been patented. U.S. Pat. No. 3,981,612 issued to Bunger et al is directed to a wave generating apparatus which uses a set of rollers mounted on a carriage that is driven along a set of rails. A flexible sheet is secured at the ends of a frame and as the carriage is driven along the rails the roller displaces the sheet upwardly so that a wave motion is produced along the sheet. This device is quite bulky and is only able to produce one displacement wave for only one set of rollers.

U.S. Pat. No. 4,915,584 issued to Kashubara discloses a device for converting fluid flow into mechanical motion using an airfoil movable within a vertical track. As air flows over the air foil the foil moves vertically up or down in the vertical track thereby transmitting movement to a set of crank arms thereby rotating an axle which is attached at the ends to the two crank arms.

U.S. Pat. No. 4,465,941 issued to Wilson et al is directed to a water engine for converting water flow into other types of mechanical energy. Water flowing toward one side of the device engages a set of butterfly valves and a wheeled carriage is pushed along the frame of the barrage.

U.S. Pat. No. 3,620,651 issued to Hufton discloses a fluid flow apparatus that may operate as a pump or motor. The device includes several flexible sheets driven in oscillatory motion by a bulky crank assembly.

U.S. Pat. No. 4,999,861 issued to Huang describes a therapeutic bed with a wave surface generated through two longitudinal shafts, a multitude of offset cams and a support mechanism.

A PCT patent application PCT/EP98/01276 issued to Nestle S. A. uses a method similar to Huang's wave bed in a peristaltic pump. A longitudinal shaft drives a number of cams that sequentially compress a tube in a wavelike manner.

U.S. Pat. No. 5,267,364 issued to Volk also describes a wave bed activated through inflation and deflation of air pockets.

Though the main complication of venous thrombosis is fatal pulmonary embolism (PE), there are other long-term complications that account for considerable suffering and health care costs. Post-thrombotic syndrome (PTS) is the most common and chronic of these. It is characterized by pain, swelling, varicose eczema and, at its most severe, venous ulceration of the affected limb, most often the calf. Venous hypertension and valvular incompetence are believed to be the main factors responsible for the development of PTS. In general, most cases of PTS manifest within 2 years of acute deep vein thrombosis (DVT) with a cumulative incidence of 17 to 50%.

PTS is responsible for considerable personal disability, reduced quality of life and increased health care costs. Despite this, available therapies including graduated pressure stockings (GCS) and pneumatic compression pumps, placed over the calf, have major clinical limitations. Although pneumatic sequential compression pumps exact symptomatic relief in most subjects who use them, they are very expensive, generally unwieldy, AC wall powered and require the patient to remain immobile in a lying position for greater than 2 hrs per day. CGS are convenient but are only effective in a minority of subjects and are often poorly tolerated. Therefore there is a clinical need to develop an effective treatment of PTS.

Pneumatic compression pumps applied for the treatment of PTS sequentially inflate and deflate air pockets within a sleeve secured over the calf in a wavelike manner, with the wave motion displacing fluid and soft tissue proximally toward the heart. The area of the calf affected by this treatment is the bulky soft tissue at the back of the calf. The large unwieldy size and power of these pneumatic compression systems is due to the inefficiency of the several energy conversion steps in this process. First AC power is turned into the mechanical work of activating a motor which compresses air. The compressed air is then routed through valves to a sleeve with several air pockets. These air pockets are then filled and voided to create the peristaltic like pumping effect on the soft tissues of the calf. Efforts to miniaturize such a system and reduce power levels so that such a device can be worn portably and operated on battery power have not been successful. The result is too little pumping to affect a reasonable result. An innovative alternative uses the walking motion of a subject to compress a working fluid under the sole of the foot which is then routed to the calf, however such a system has no effect when the subject is standing still or sitting.

Deep Vein Thrombosis (DVT) prophylaxis is achieved either by anticoagulants or physical methods. Anticoagulants have side effects, among them increased risk of internal bleeding, which makes them undesirable for some applications, and particularly following major orthopaedic surgery. Of the physical methods, pneumatic compression pumps (devices that pump blood from the calf veins towards the heart)

are the most successful and graduated compression hose significantly less so. There is now good evidence that prophylaxis for venous thrombosis should be continued after hospital discharge, because patients remain at risk for up to 6 weeks. Continuing post-discharge prophylaxis is possible with anticoagulants, but not with the available calf compression devices, since the latter are large, unwieldy, need an AC power source, and therefore cannot be used when patients are ambulant. The peristaltic wave-generating device described above is the only wearable ambulatory pump that can achieve DVT prophylaxis comparable to pneumatic compression devices and anticoagulants; hence there is a significant clinical need and advantage to the use of this device It would therefore be advantageous to provide a compact wave generating device that can be used for producing wave motion for use in chairs, beds or other therapeutic devices.

SUMMARY OF THE INVENTION

It is an object of the present invention to provide a mechanism that can be used for generating transverse wave motion.

An advantage of the present invention is that it provides an apparatus for generating transverse wave motion that can be adapted for numerous applications including but not limited to wave beds, wave chairs, wave pumps, visual display surfaces and propulsion systems.

In one aspect of the invention there is provided an apparatus for generating wave motion, comprising:

a) a flexible member and at least one link member having opposed first and second end portions and being rigidly attached at said first end portion to said flexible member;

b) oscillatory drive means connected to an inertial anchor, said oscillatory drive means including a crank assembly, and said at least one link member being attached to said crank assembly at said second end portion so that when said oscillatory drive means is engaged said second end portion undergoes oscillatory motion to produce transverse wave motion along said flexible member; and c) the oscillatory drive means including control means for controlling a velocity of the transverse wave motion between a pre-selected upper velocity and zero velocity in which traveling waves produced by the transverse wave motion can be stopped at any point to freeze a wave shape in the flexible member.

In another aspect of the invention there is provided an apparatus for generating wave motion, comprising:

a) a flexible member;

b) oscillatory drive means attached to said flexible member, said oscillatory drive means including a motor and a motor shaft having a longitudinal axis attached to the motor which is rotated by the motor, and a crank assembly connected to the motor shaft;

c) at least two link members each having opposed first and second end portions, the at least two link members being spaced apart a first pre-selected distance from each other and each being rigidly attached at their respective first end portions to said flexible member; and d) at least one elongate beam, said at least two link members being pivotally attached to said at least one elongate beam, the crank assembly including a crank housing pivotally connected to the motor shaft, the crank housing including a ball socket, a ball trunion including a trunion shaft with a ball portion at one end of the trunion shaft, the ball portion of the ball trunion being located in the ball socket and the other end of the trunion shaft being rigidly attached to the at least one elongate beam so that when the motor shaft is rotated by the motor the trunion shaft undergoes rotation in a circular path about the longitudinal axis thereby causing the at least one elongate beam to undergo oscillatory motion which produces transverse waves along said flexible member.

In another aspect of the invention there is provided a wave generating device for pumping bodily fluids in a person, comprising;

a) a flexible member;

b) two elongate beams and two link members connected to each of the two elongate beams, each link member having opposed first and second end portions, the two link members associated with each of the two elongate beams being pivotally attached at said second end portions to said associated elongate beam, and each link member being rigidly attached at their respective first end portions to said flexible member;

c) oscillatory drive means operably coupled to said flexible member for producing transverse wave motion in said flexible member, said oscillatory drive means including a motor coupled to a two-sided crankshaft having a crank attached to each end of the two-sided crankshaft, each crank having a pin attached thereto which engage the elongate beams so that so that when the motor rotates the two-sided crankshaft thereby rotating the two cranks the two elongate beams undergo oscillatory motion which produces transverse waves in the flexible member; and d) securing means for attaching said wave generating device to a person with said flexible member bearing against a part of a person's anatomy through which body fluids are to be pumped.

The present invention also provides a method of preventing and/or mitigating effects of post thrombotic syndrome (PTS), comprising:

attaching a motor driven wave generating device for pumping bodily fluids to a portion of a person's body, the wave generating device including a flexible member in which transverse waves are produced which is placed on the portion of the person's body so that when transverse waves are produced in the flexible member bodily fluids are pumped in the persons body in the region adjacent to the flexible member.

The present invention provides a method of preventing and/or mitigating effects of deep vein thrombosis (DVT) comprising:

attaching a motor driven wave generating device for pumping bodily fluids to a portion of a person's body, the wave generating device including a flexible member in which transverse waves are produced which is placed on the portion of the person's body so that when transverse waves are produced in the flexible member bodily fluids are pumped in the persons body in the region adjacent to the flexible member.

In another aspect of the present invention there is provided a universal crank assembly, comprising:

a crank housing being pivotally attachable to a motor shaft which is driven by a motor, the motor shaft defining a longitudinal input axis about which the motor shaft rotates, the crank housing including a ball socket; and a ball trunion including a trunion shaft defining an output axis and having a ball portion at one end of the trunion shaft, the ball portion of the ball trunion being located in the ball socket and the other end of the trunion shaft being rigidly attachable to a member which is to be rotated in a circular path so that when the motor shaft is rotated by the motor the trunion shaft undergoes rotation in a circular path about the longitudinal axis thereby causing the member to which the trunion shaft is rigidly attached undergoes oscillatory motion in a circular path, and wherein the ball trunion and ball socket provide compensation when the input and output axes are non-aligned.

BRIEF DESCRIPTION OF THE DRAWINGS

The following is a description, by way of example only, of an apparatus for generating waves constructed in accordance with the present invention, reference being had to the accompanying drawings, in which:

FIG. 13(*b*) is a side view of another embodiment of a wave generating apparatus for producing variable wavelength waves;

FIG. 18(*b*) is a cross sectional view taken along the line 18(*b*)-18(*b*) of FIG. 18(*a*);

FIG. 21 (*b*) is a perspective view of the boat and rudder of FIG. 21 (*a*);

DETAILED DESCRIPTION OF THE INVENTION

Figure 1:
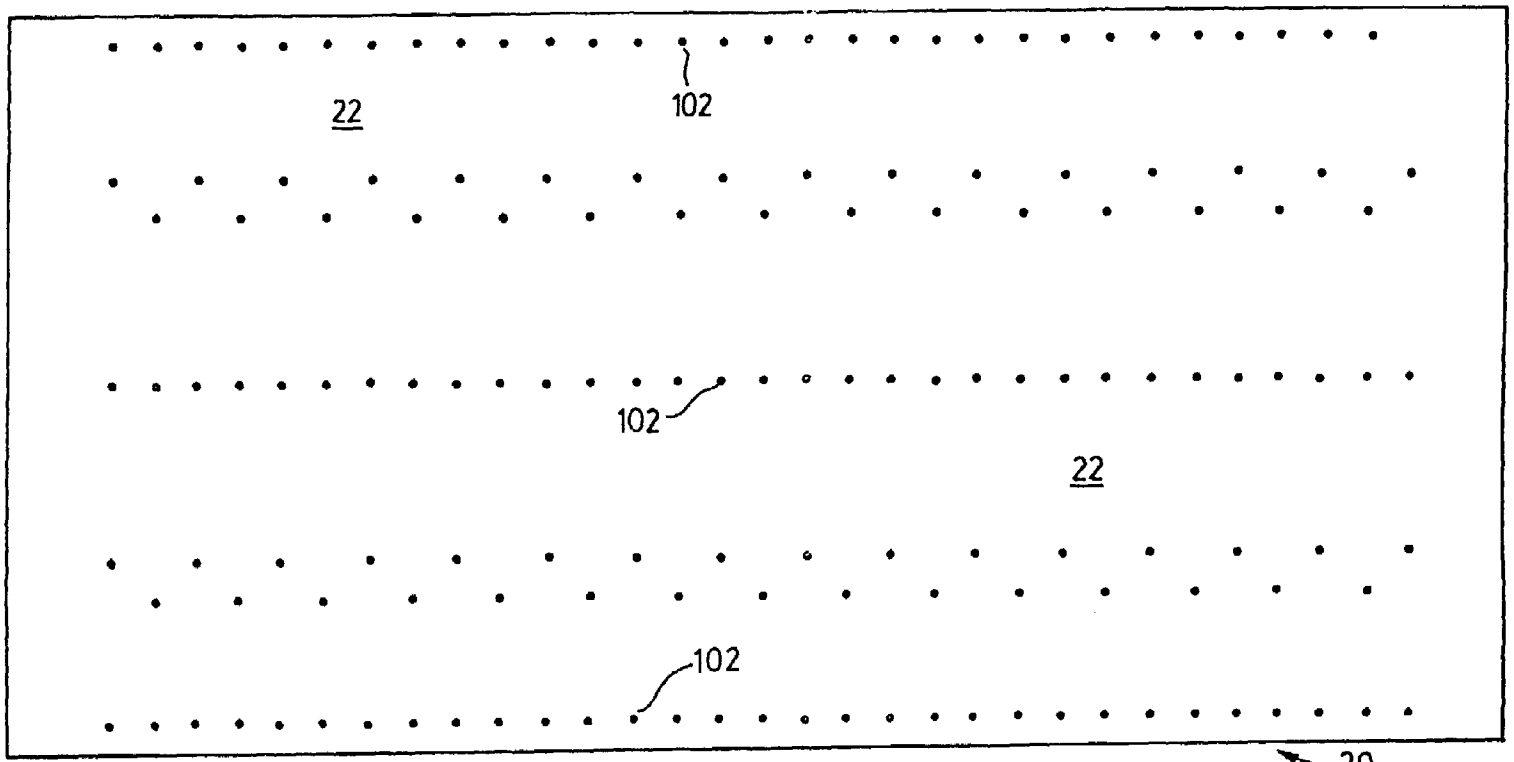
FIG. 1 is a plan view of a bed containing a wave generating apparatus constructed in accordance with the present invention.
Figure 2:
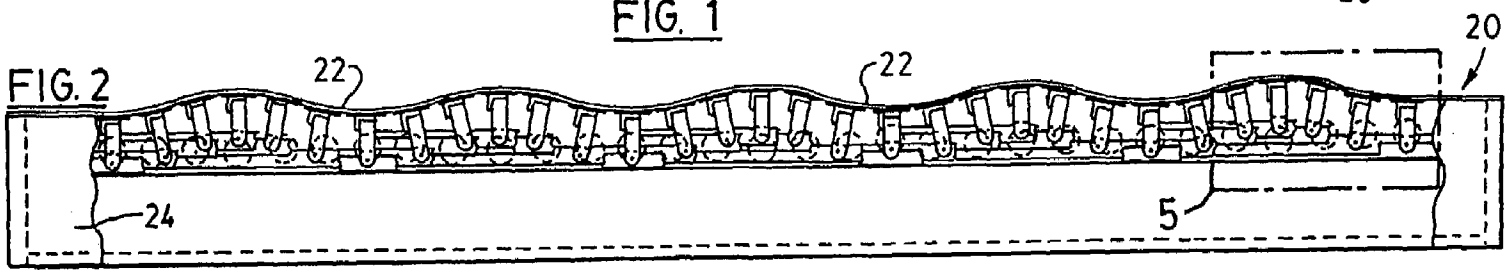
FIG. 2 a side elevation view of the bed, shown in FIG. 1, in part section.
Figure 3:
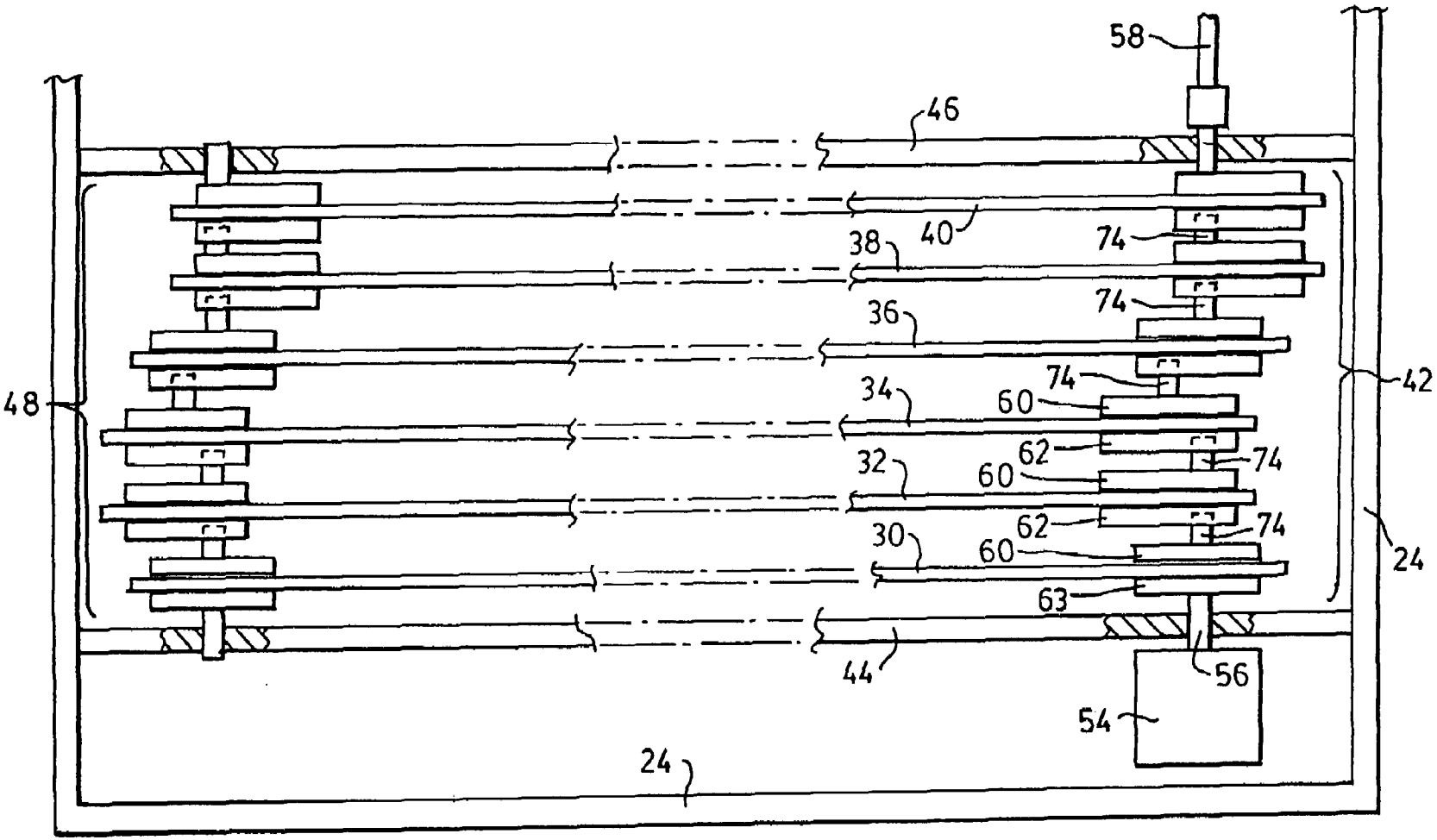
FIG. 3 is an underside view of the links of FIGS. 5 through 10, shown collectively with each arm broken.

Referring first to FIGS. 1 and 2, a wave bed constructed in accordance with the present invention is shown generally at 20. Bed 20 includes a flexible panel member 22 preferably made of a flexible plastic sheet and a support frame 24 (FIG. 2). Referring to FIG. 3 which shows a portion of the underside of the bed, the wave motion generated in bed 20 is developed using a wave generating apparatus that includes a series of six parallel beams 30, 32, 34, 36, 38 and 40 which are attached at one end of each beam to crankshaft assembly 42 mounted between support rails 44 and 46. The other ends of the beams are connected to an idler crankshaft assembly 48, which is not motor driven, mounted between support rails 44 and 46. A gear motor 54 is attached to crankshaft assembly 42 so that rotational motion of gear motor shaft 56 is converted into both lateral up and down movement of each of the beams as well as angular deflection equal to the tangential slope of the driven wave. It is noted that a motor is not essential in that the shaft could be turned manually to same effect. It is also noted that any beam can act as a support beam for a motor or generator with the motor or generator engaging the crankshaft at its respective point of pivoting attachment.

An extension shaft 58 is mounted in support rail 46 which can be attached to an additional bank of wave generating links. Additional banks of wave generating links can be spread across the width of the bed.

Figure 4:
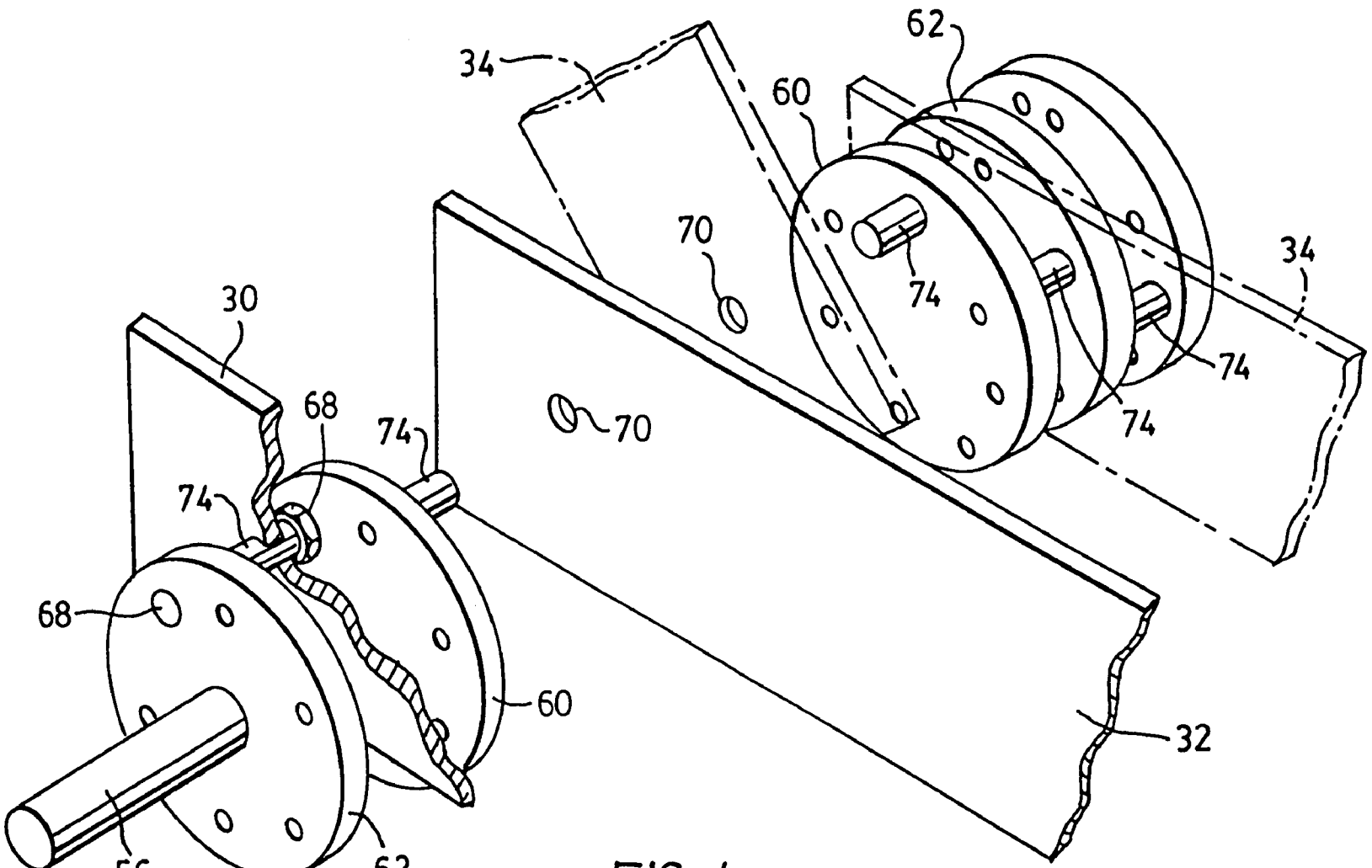
FIG. 4 is a perspective view of a bearing plate exploded from a link arm.

FIG. 4 is a simplified diagrammatic representation of a crankshaft assembly connected to the beams to impart circular motion to the beams which is translated into wave motion along the flexible sheet. A pair of bearing plates 60 and 62 respectively are mounted on either side of each beam, in this case beams 30, 32 and 34. Motor shaft 56 is attached to the center of plate 62 attached to first beam 30. Each plate 60 and 62 is shown with a hole 68 spaced from the perimeter of each bearing plate. A crank pin 74 is inserted through a hole 70 located in the end portion of each beam and is secured in hole 68 in plate 62 on one side of beam 30 and in a hole 68 in plate 60 on the other side of is beam 30. In the representation of FIG. 4 each pair of discs 60 and 62 connected by a crank pin 74 through hole 70 in the beam does not move with respect to each other. When drive shaft 56 is driven by the motor the discs rotate about the longitudinal axis of shaft 56 and since the crank pins are offset from this axis the beams are driven in a circular path in planes that are perpendicular to the axis of rotation of the crank. The crank assembly is shown assembled with adjacent crank pins spaced 60° apart since there are six beams making up the bank.

The other ends of each beam in the bank of beams are similarly attached to an idler crankshaft assembly 48 with the difference being no motor is provided (FIG. 3). Each of the six beams 30, 32, 34, 36, 38 and 40 has a unique phase so that each beam is 60° out of phase with all the other beam in the bank so the bank of beams defines a total phase difference of 360°. On each beam, the two bearing plates 60 and 62 remain fixed with respect to each other so that when in operation, as shaft 56 is rotated by motor 54, every point on all the beams undergoes circular motion with a 60° phase difference between the beams.

Figure 5:
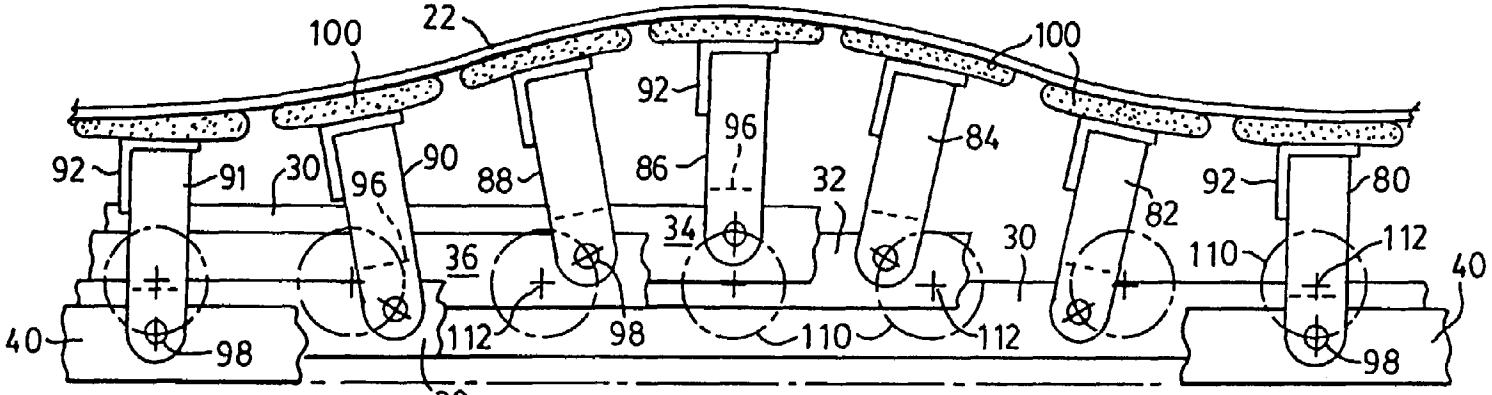
FIG. 5 is an enlarged view of a portion identified as 5 in FIG. 2.
Figure 6:
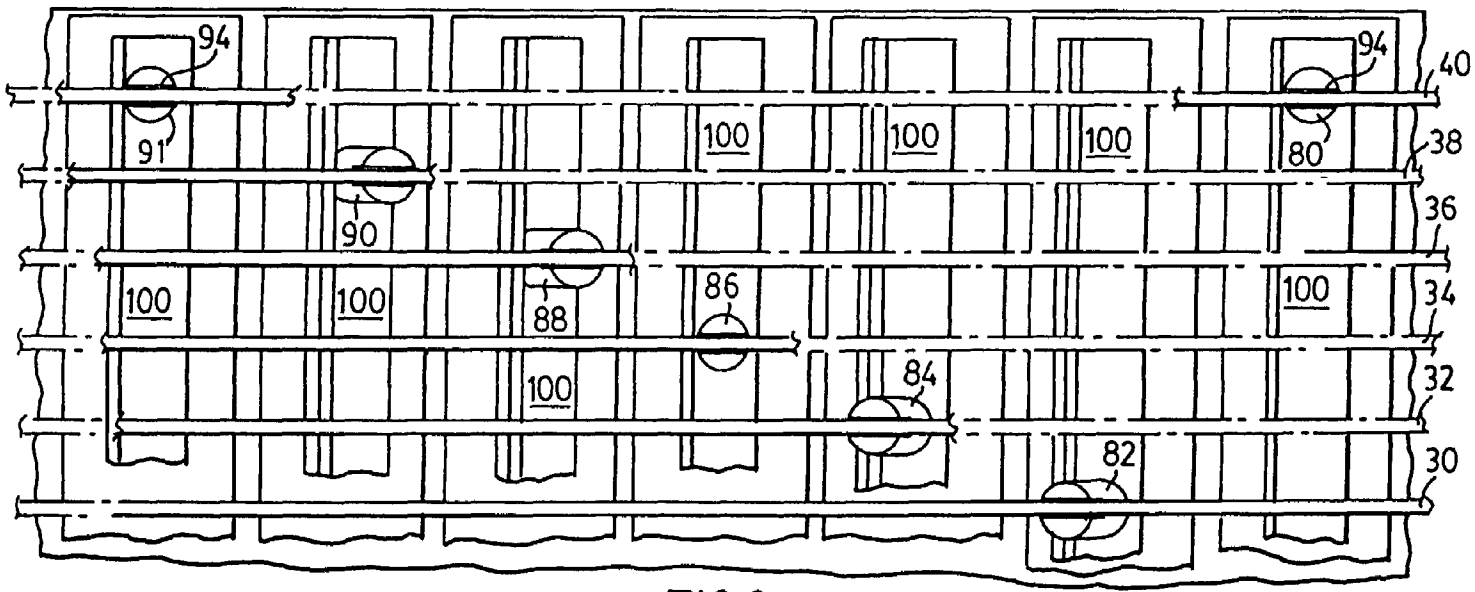
FIG. 6 is an underside view of FIG. 5.
Figure 7:
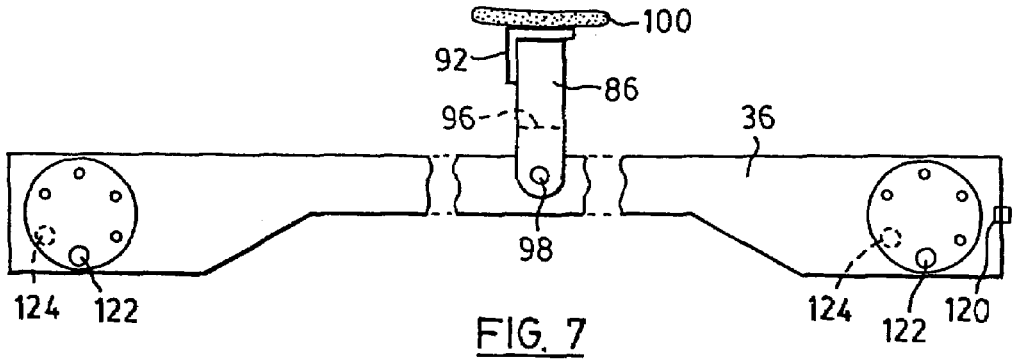
FIGS. 7 to 12 are vertical side elevation views of the link arms shown in FIG. 3 showing one revolution of the present wave generator.
Figure 8:
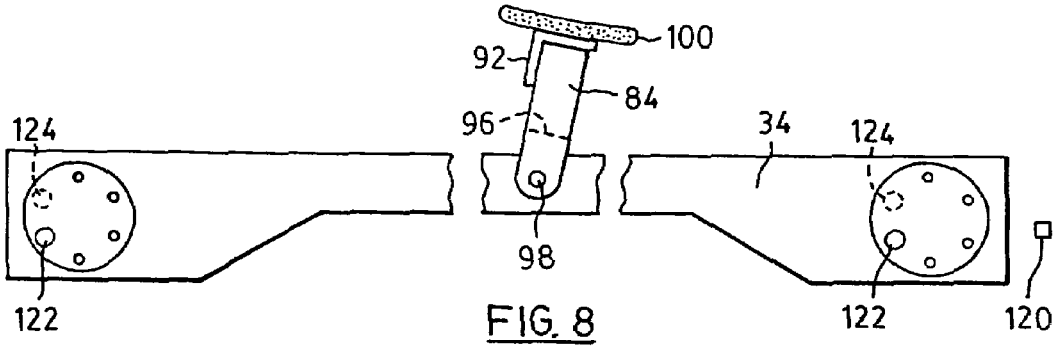
Figure 9:
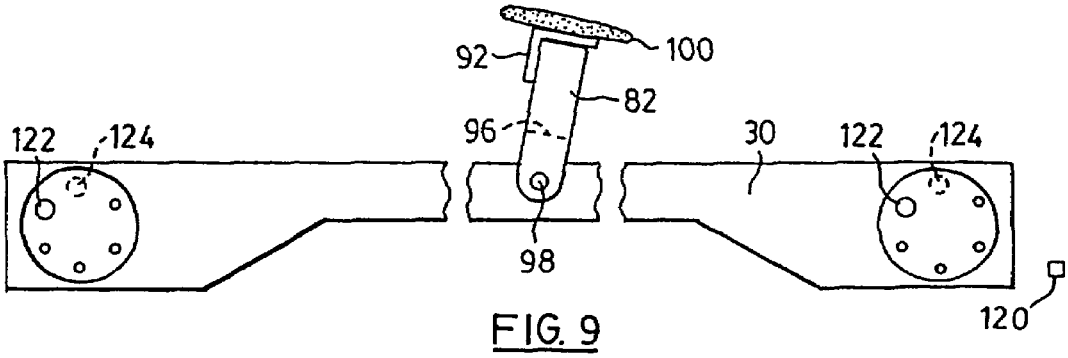
Figure 10:
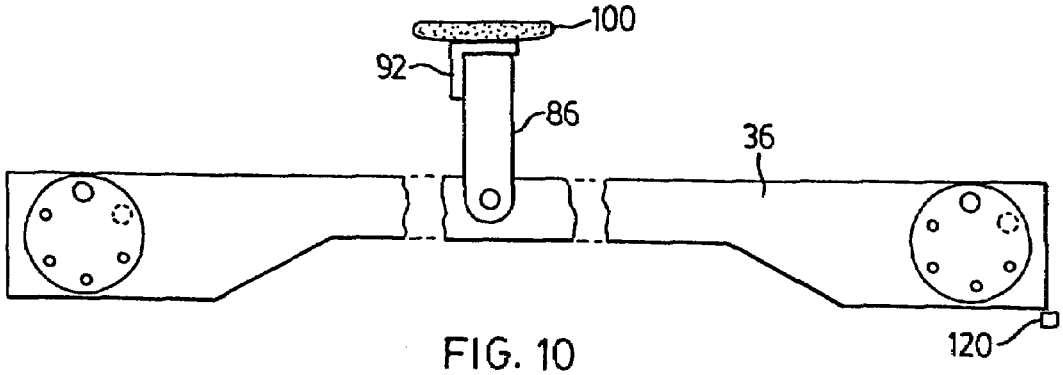

FIG. 5 is an enlarged view of section 5 of FIG. 2 showing seven cylindrically shaped links or drive rods 80, 82, 84, 86, 88, 90 and 91 connected respectively between beams 40, 38, 36, 34, 32, 30 and 40 and the underside of panels 100. These drive rods need not be cylindrical and may be flat if desired. Each of the drive rods is pivotally connected at one end to its associated beam for pivotal movement about pivot point 98 and extends away from the beam in the plane in which the beam moves. FIG. 6 shows the underside of this enlarged section of FIG. 5. Each link is connected at one end to a bracket 92 which in turn is connected to the underside of panel 100. Each cylindrical arm is provided with a slot 94 (FIG. 6) at the other end thereof extending up to dotted line 96 (FIG. 5) with the slot being wide enough to receive therein the associated beam. Panels 100 extend transversely across the underside of flexible sheet 22 and the sheet is attached to the panels by rivets 102, best seen in FIG. 1.

Since each point on each beam, regardless of shape, goes through a circular arc in a plane perpendicular to the axis of rotation of the crank, the drive rods 80, 82, 84, 86, 88 and 80' being pivotally attached to each beam, pivot in the same plane in which the beams undergo circular motion. Therefore, because the drive rods are rigidly connected to flexible sheet 22, when the crankshaft is rotated the circular motion of the beams creates a traveling wave along the flexible sheet, see FIG. 2. When the crank is rotated in one direction transverse waves are produced traveling in one direction in the flexible sheet 22 and reversing direction of rotation of the crank assembly reverses direction of the traveling transverse wave motion.

It will be understood that the idler crankshaft assembly 48 is optional but if present does not need to be located at the other end of the bank of beams. It could be located anywhere along the length of the beams as long as it is spaced from the first crankshaft assembly 42. When the idler crank is present the beams are forced into parallel arrangement so that all parts of the beam undergo circular motion. The motor driven first crank assembly may be positioned where most convenient along the beams and may be attached directly to one of the beams acting as a support.

It is also understood that the idler crank is only one way of forcing a parallel arrangement of beams and that various other means may be used with similar effect and function. For example, in the case where the beams are driven synchronously with a crankshaft, any two parallel beams will rotate around the other at all points, so that an offset hinging mechanism can be installed anywhere between any two beams to cause parallel alignment.

In a preferred embodiment a modular wave bed assembly with a bed frame having a central cut-out portion may be provided and a modular wave bed insert may be dropped into the cut-out portion. The modular wave bed insert includes two beams a little shorter than the wave bed surface with the small motor attached to one beam and crank engaging the second beam. The motor and crank are located midway along the length of the beams in the middle of the flexible plastic sheet on its underside. The two beams are connected to a crank with the beams 180° out of phase. The reinforcing panels 100 shown in FIG. 6 may be replaced by reinforcing ribs integrally formed with the sheet. For example when plastic is used to produce the planar flexible supports 22 reinforcing ribs or slats can be produced as an integral part of the sheet. Similarly, the links rigidly connected to the support 22 and pivotally attached to the beams can be molded along with the sheet to form an integrated unit. This reduces the number of components to be assembled thereby simplifying assembly.

Since the modular wave bed insert is a self-contained unit, it can be easily transported. A support frame per se is not required since the unit could be supported on a piece of foam as in a mattress and still operate.

Those skilled in the art will understand that the basic components of the present apparatus for generating transverse wave motion from rotary motion includes a rotating crank, pivotally engaging a link member at one end with the second end thereof rigidly connected to a flexible member in which a transverse wave is induced through the crank rotation, with the wavelength proportional to the link length. A plurality of such crank positions may be synchronously connected through a means such as a beam, each beam attached to pivots one wavelength apart and out of phase with the other beams, and all interconnected through a synchronising crankshaft which fixes the phase differences between the beams. These beams may be flexible or of complex shape to allow the wave to change direction. Alternatively, the synchronising means may be an electrical control of separate drive motors each connected to a crank position, or a chain, wire or belt interconnecting the crank positions, or any combinations thereof.

As mentioned above, when an idler crank assembly or a functionally equivalent mechanical linkage is used to constrain the beams the oscillatory motion is pure circular motion. For example, in the case where the beams are unconstrained by an idler crank the motion of the beams is more broadly described as being oscillatory which may include various parts of each beam undergoing circular, reciprocating and/or elliptical motion. For example, in the case where one end of the beams are constrained to undergo reciprocal movement (constrained by a boss in a slot at one end of the beam) the driven crank assembly drives the portion of the beams local to the point of attachment to the crank in a circular path. In this example the constrained ends of the beams undergo reciprocating motion and the unconstrained ends of the beams undergo elliptical motion in the plane substantially perpendicular to the axis of rotation which produces transverse waves in the flexible sheet.

Furthermore, if the crank length is adjustable, variable or flexible rather than fixed, as in a cam or other functionally similar mechanical linkage, then various non-circular rotating periodic motions may be generated by a rotating drive source to generate flexible or fixed waves of varying shapes and amplitudes. It is also understood that a drive source may also be a drive sink so that wave energy can be extracted from, for example, ocean waves, to generate power.

Figure 29:
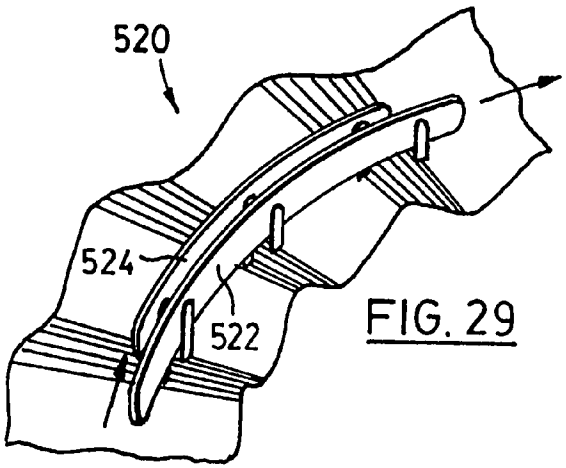
FIG. 29 shows the wave generating device embodiment with flexible beams and a changing wave trajectory.

Traveling waves of variable amplitude across the width of the flexible sheet can be produced by constraining one edge of the sheet running parallel to the length of the beams so the amplitude increases across the width of the sheet, much like a fan. In this case the beams may be bent into a curve along the direction of wave travel as shown in FIG. 29.

FIG. 5 illustrates one period of a wave generated by the wave generating apparatus and shows the relative positions of the drive rods 80, 82, 84, 86, 88 and 90. The middle drive rod 86 and the end drive rods 80 are vertical as seen in FIGS. 5 and 6 while the remaining links are at different angles from the vertical, also evident in FIGS. 5 and 6. The links on each separate beam are spaced by a distance equal to the desired wavelength. For example, in FIGS. 5 and 6, the two link members 80 on beam 40 are spaced one wavelength apart. The drive rods or links from the six different beams are interleaved at equal phase intervals so as to produce a traveling wave in the flexible panel 22 so that a complete wave passes during each full rotation of the crankshaft assembly 42. The broken circles 110 encircling the center points 112 represent the circular movement defined by the pivot points 98 during operation of the wave generator.

FIGS. 7 to 12 show the individual positions of the different link members in FIGS. 5 and 6 over one wave period. At the right of each drawing is a cross (+) 120 to represent a fixed center of rotation to which the moving links can be referenced against. The crosses 120 are shown at the same end portion of the bed to which the motor driven crank assembly 42 is located.

In alternative embodiments of the wave generating device different number of beams may be used. For example, when four beams are used to generate the wave motion the studs will be at an angle of 90°. Therefore, it will be understood that the angular displacement is calculated by dividing 360° by the number of desired beams to give the required angular displacement between adjacent beams. It should also be noted that an irregular division of angular displacements, while feasible, will necessitate a similarly irregular spacing of links along the flexible member in order to maintain synchronous motion. A regular division of angular displacements results in a regular spacing of links.

Figure 13A:
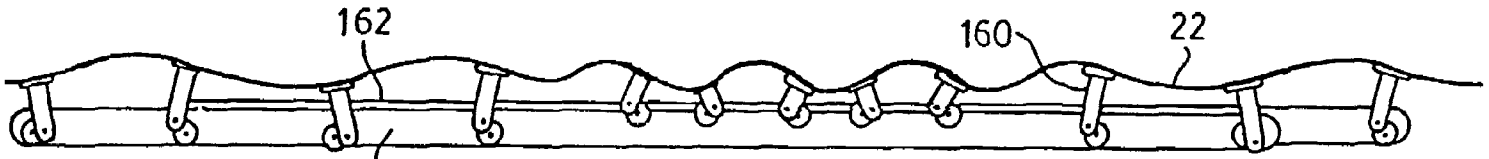
FIG. 13(*a*) is a side view of a wave generating apparatus for producing variable wavelength waves.
Figure 13B:
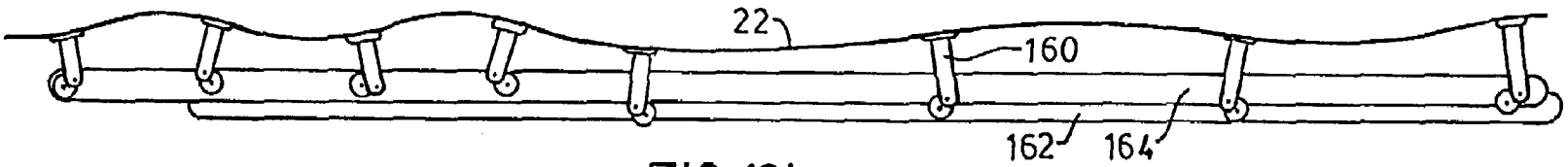

The length of links 82, 84, 86, 88 and 90 determines the amount of angular displacement of the link. It will be understood that the term drive rod and link member refer to the same components. The length of the drive rod or link is determined so that the resultant angle approximately matches the tangential slope of the driven wave at any crank angle. The relationship between wavelength and drive rod length for constant amplitude is illustrated in FIGS. 13*a* and 13*b* with drive rods or link members 160 connecting flexible sheet 22 to beams 162 and 164. In FIG. 13(*a*) the wavelength decreases in direct proportion to decreasing length of the drive rods 160 and the distance between the links. In FIG. 13(*b*) the drive rods 160 lengthen as does the distance between the links to create a wave of increasing wavelength in flexible sheet 22. This illustrates the relationship between wavelength and link length with amplitude remaining constant. It also shows how a device with a varying wavelength along its length can be generated from a single mechanism. It also follows that the wave velocity slows down as the wavelength shortens and then speeds up again as the wavelength increases again, since with every turn of the crank the wave moves ahead by one wavelength, whatever the wavelength.

Therefore, traveling transverse waves with preselected wavelength may be produced along the flexible sheet using the present apparatus by adjusting the length of the link members, the spacing between them on the beams and spatially interleaving the links on the different beams.

The amplitude of the transverse wave is determined by the effective crank length which is defined as the distance from the center of crank rotation relative to an inertial reference point to the point of attachment of a beam to the crank and is equal to one half the total wave amplitude as measured from peak to trough of the wave. Therefore, in the case of circular motion with the crank assembly of FIG. 4, increasing the distance from the center of shaft 56 to the center of pin 74 increases the amplitude of the wave. This corresponds to increasing the radial distance along plates 60 (62) of the attachment point of the beam 30. If the crank is connected to a beam or rib rather than an inertial reference point then the wave amplitude will decrease accordingly since both the center of rotation of the crank as well as the point of crank attachment rotate about a common center. The effective crank length in this case becomes the distance from the common center of rotation to the point of attachment or center of crank rotation.

Figure 14:
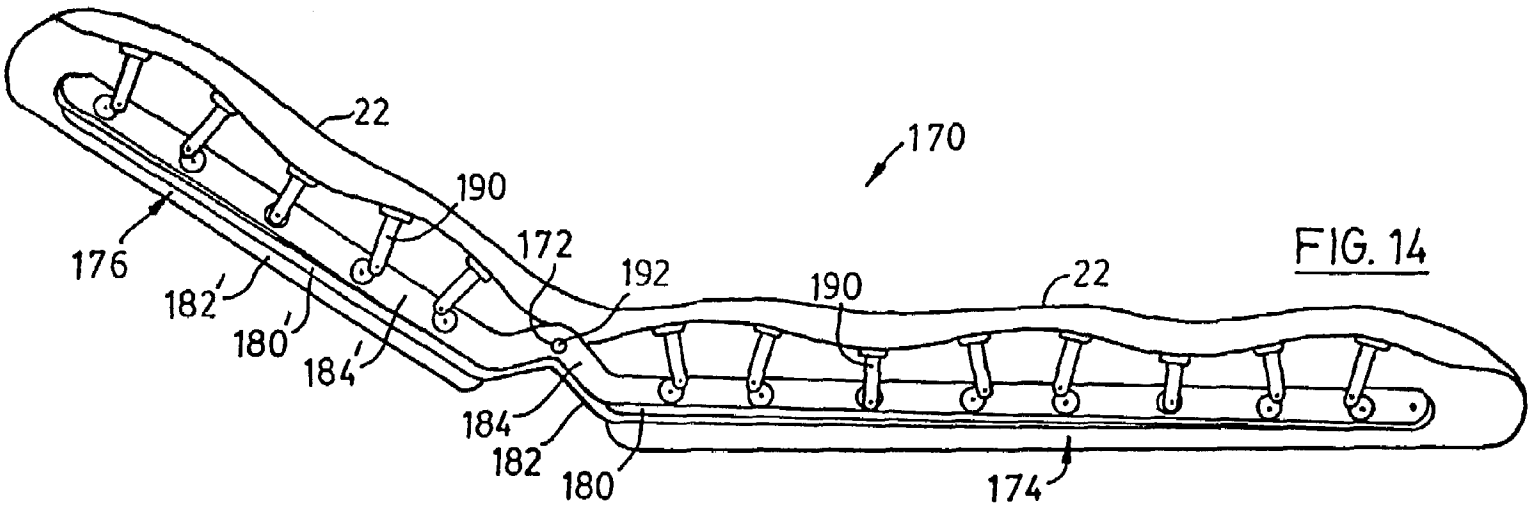
FIG. 14 is another embodiment of a wave bed constructed in accordance with the present invention.
Figure 15A:
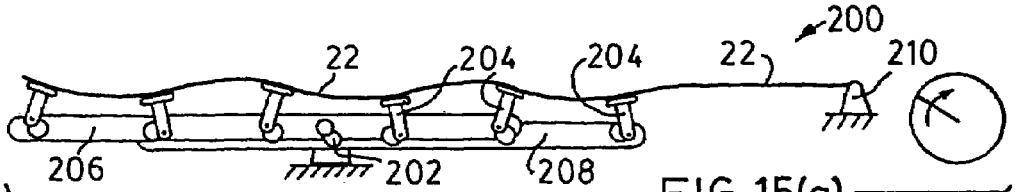
FIGS. 15(*a*) to 15(*f*) illustrate a dual beam wave generating apparatus.
Figure 15B:
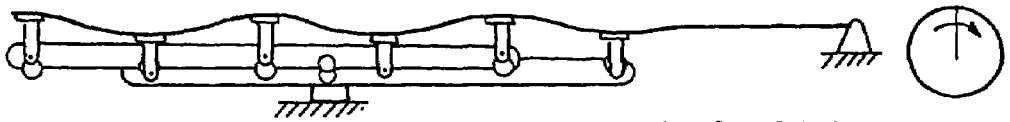
Figure 15C:
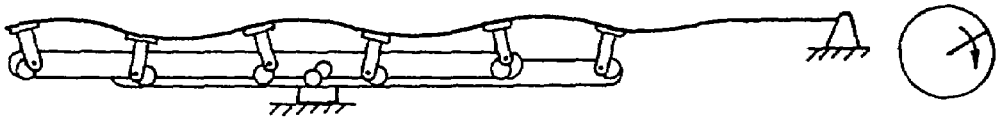
Figure 15D:
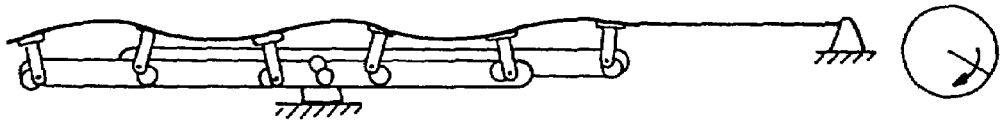
Figure 15E:
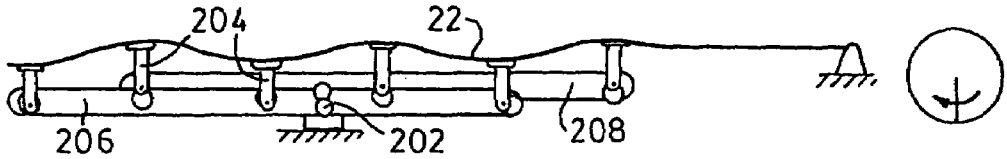
Figure 15F:
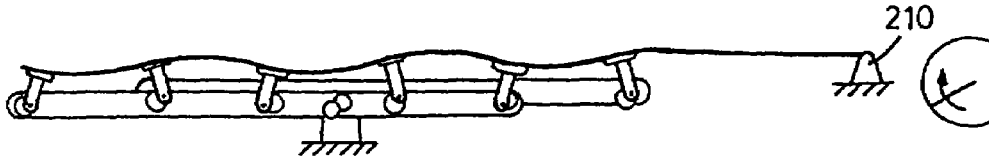

FIG. 14 shows an alternative embodiment of a wave bed with a crankshaft assembly 180, (similar in structure to crankshaft assembly 42 in FIG. 3) joining and transmitting power between two sets of beams 174 and 176. Set of beams 174 includes three beams 180, 182 and 184 respectively connected to beams 180', 182' and 184' in set 176. Idler cranks may be located at the other ends of each bank of beams. Flexible sheet 22 is connected by drive rods 190 to the respective beams. The axis 192 of the crankshaft 180 is located in the plane of the flexible sheet 22 so that flexing at the pivot point between the beams does not elongate the sheet. The beams and drive rods are also located on the two sides of the flexible sheet so that the hinge and beams do not interfere with the flexible sheet. Alternatively the mechanism can be upside down as shown in the side sketch allowing for a more compact packaging. This embodiment allows a single drive means on any crank to transmit power through (multiple) hinged joints and a flexible sheet that not only propagates a wave along its length, but also flexes around hinge points. This can be important in a wave bed since the hinges could allow for the bed to hinge upward as a back support as is required on hospital beds, as illustrated in the sketch or on a reclining chair, etc. FIG. 14 shows the second bar that pivots on a common crank in a 6-beam mechanism. In the 3-beam mechanism, the crank pins are 120 degrees apart rather than 60 degrees as shown.

The progression of FIGS. 15(*a*) to 15(*f*) illustrate a dual beam system at 200 comprising a single crank shaft 202 and three drive rods 204 connecting each of beams 206 and 208 to flexible sheet 22. It will be understood that only two drive rods on each beam are required. The progression illustrated from FIGS. 15(*a*) to 15(*f*) shows the crank angle advancing 60 degrees between consecutive Figures, with the wave advancing one full wavelength through the entire progression back to the start point. The flexible sheet 22 is attached at 210 thereby constraining it from moving horizontally so that it can only move vertically. The beams rotate in a circular arc transmitting a vertical deflection on the flexible sheet as well as imparting a slope equal to the correct tangential angle of the pseudo-sinusoidal wave surface. It is because each drive rod imparts two constraints (vertical deflection as well as slope) to the flexible sheet 22 that a wave can be generated with a minimum of moving parts, optimum mechanical efficiency, and least mechanical complexity. Of note is that in this embodiment, the crank is attached to one of the beams and both the crank center and crank pin rotate around a common inertial center. In this case the wavelength and the apparent crank length are the same.

Figure 40A:
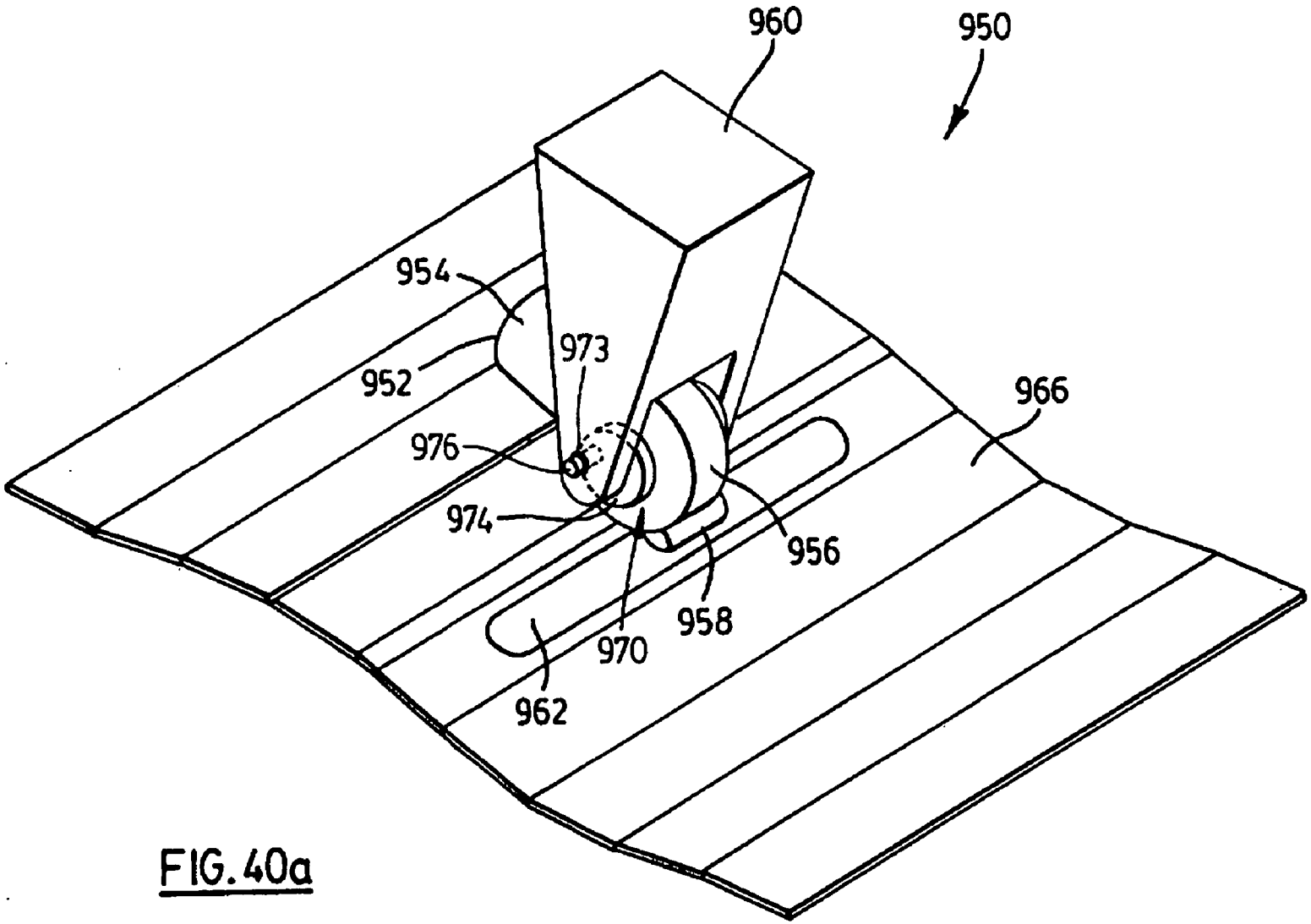
FIG. 40*a* shows a perspective view of another embodiment of a wave generating device without beams.
Figure 40B:
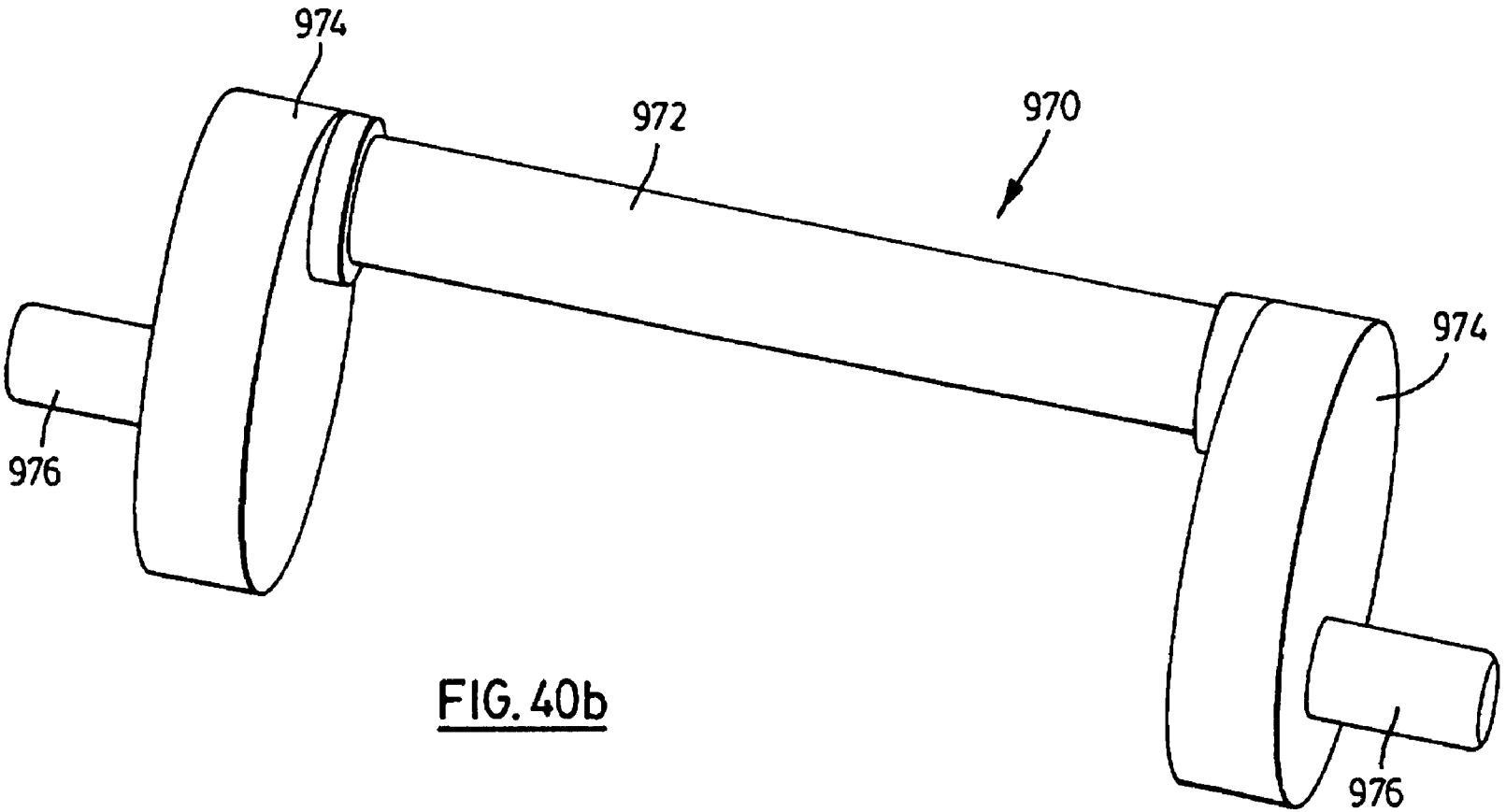
FIG. 40*b* shows a perspective view of part of an off-center crank assembly used in the apparatus shown in FIG. 40*a;*
Figure 40C:
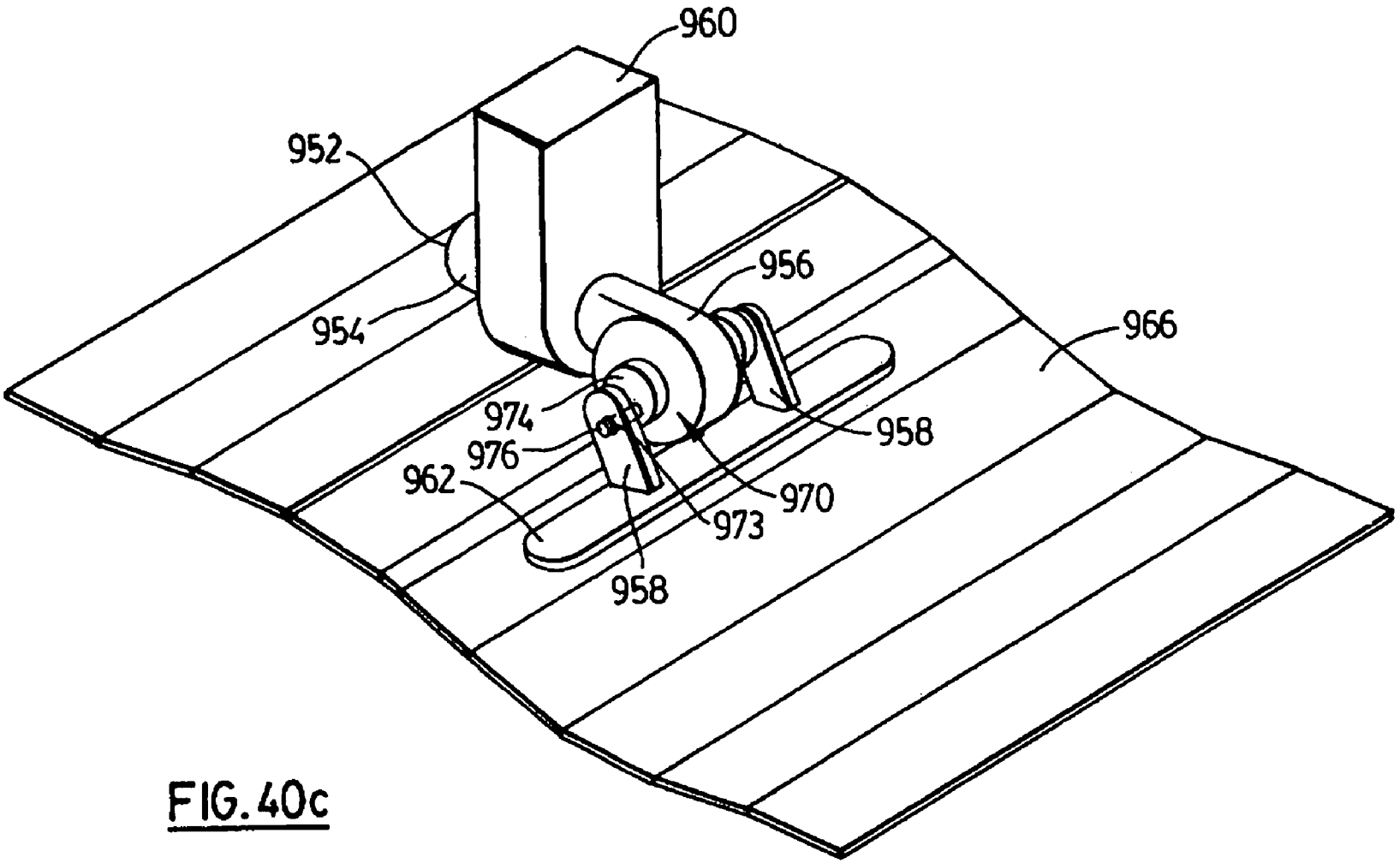
FIG. 40*c* shows a perspective view of another embodiment of a wave generating device without beams.

Referring to FIG. 40*a*, it will be understood that the simplest possible wave generating apparatus, shown generally at 950 constructed in accordance with the present invention includes an oscillatory drive motor 952 within a motor housing 954, with the motor driving a rotating crankshaft 970 which engages an inertial anchor 960 so that rotation of the crank 970 causes oscillatory motion of the motor assembly relative to the inertial anchor 960. The crankshaft housing 956 is rigidly attached to the rib 962 via a boss 958 to form an integral link assembly linking the flexible sheet 966 and the oscillatory drive. The axis of rotation of crank 970 is offset from the hole 973 in the inertial anchor 960. FIG. 40*b* shows crankshaft 970 showing the offset using a rod 972 connected to the outer periphery of two circular discs 974 with the crank pins 976 projecting from the discs 974. In the above embodiment, the motor assembly is attached to the rib and oscillates relative to the inertial anchor. An alternative embodiment has the motor housing 954 rigidly attached to the inertial anchor 960 with crankshaft 970 driving the rib 962. The crank shaft 970 is connected to the second end portion of at least one link member 959. If the oscillatory drive motor 952 is rigidly connected to the inertial anchor 960 then the crank shaft 970 would need to engage the rib 962 as shown in FIG. 40*c*. It does not matter if the oscillatory drive motor 952 is attached to the flexible member 966 or the inertial anchor 960 since either way, the same relative oscillatory movement is achieved. Both of these embodiments generate a wave segment of less than one wavelength along the flexible member 966.

The inertial anchor 960 may be any arbitrary external mass (in a wave propeller, it could be the mass of the boat, in a chair, the frame of a chair, and the like) to which the wave drive can be anchored and is an alternative to anchoring the drive to another anchor referenced back to the wave itself, such as a beam.

The addition of one or more beams becomes necessary when longer wave segments of one or more wavelengths are required or where the support for the crank is another element of the wave assembly so that the crank center and crank pin are respectively attached to counter rotating elements.

Figure 16:
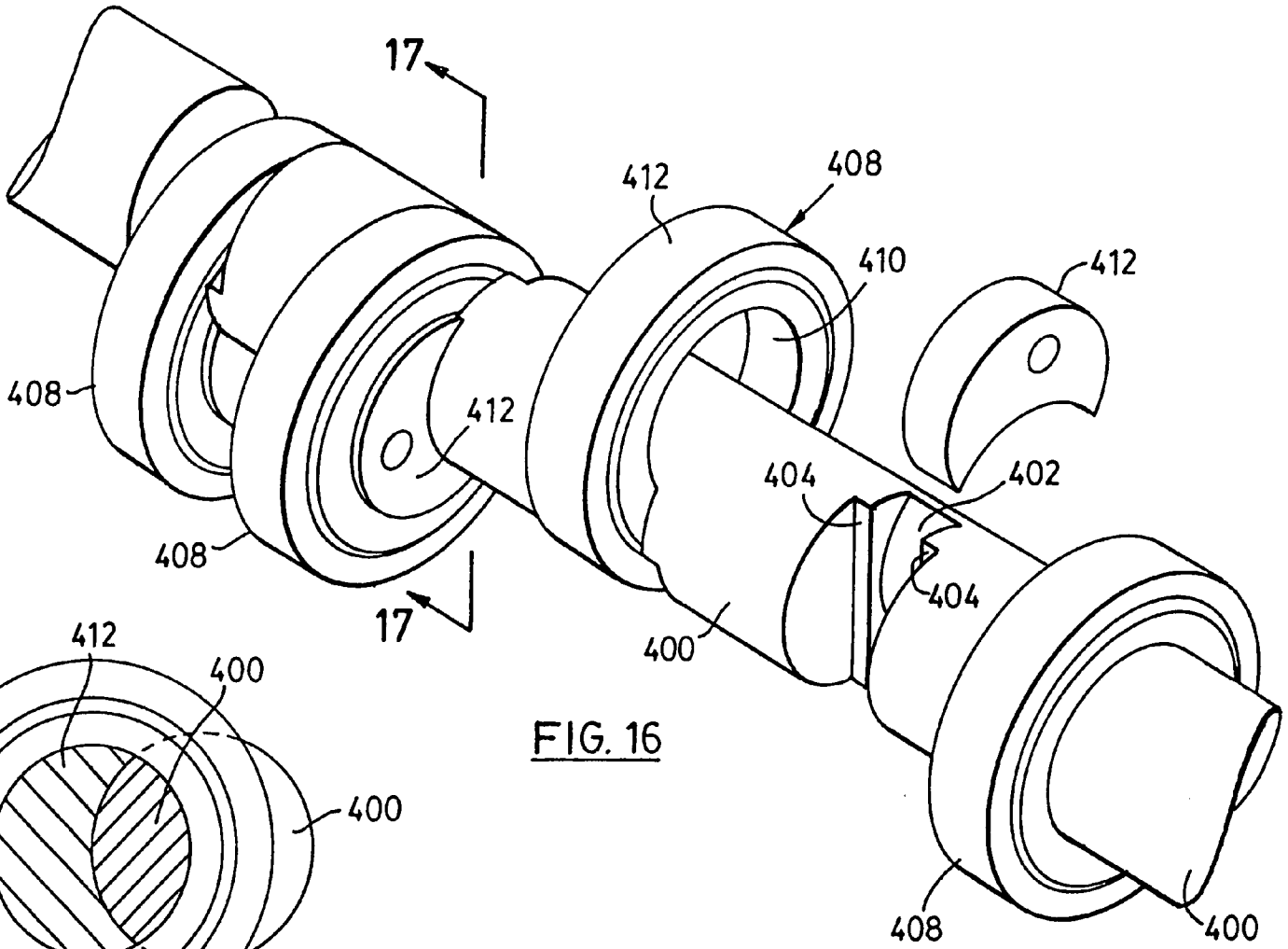
FIG. 16 is a perspective view, broken away, of a crankshaft assembly used for generating wave motion according to the present invention.
Figure 17:
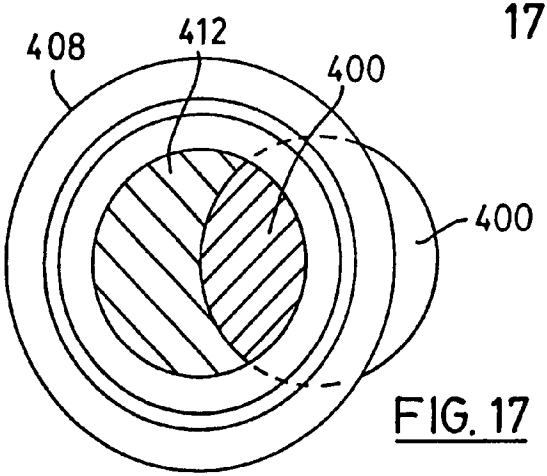
FIG. 17 is a cross sectional view taken along the line 17-17 in FIG. 16.

FIGS. 16, 17, 18(*a*) and 18(*b*) illustrate a preferred embodiment of a crank shaft assembly for a four beam bank with a 90° phase difference between each of the beams in the bank. Referring specifically to FIGS. 16 and 17, a section of a crankshaft 400 is shown with four slotted sections cut out of the shaft. Each slotted cut-out section includes a curved slotted portion 402 and two straight shoulder sections 404 on either side of the curved section 402. A cylindrical bearing assembly 408 with an inner cylindrical section 410 and an outer cylindrical section 412 sits in each slotted section with a portion of the curved surface of inner section 410 of the bearing assembly seated on the curved section 402 machined to have a matching curvature. The bearing assembly 408 is maintained in this position on the shaft 400 by the crescent shaped retainers 412 being inserted between the shaft and the inner curved surface of section 410. The shaft shown in FIG. 16 is used in a four beam bank so the bearings are rotationally displaced from adjacent bearings by a 90° phase difference to give a total of 360°.

Figures 18A, 18B:
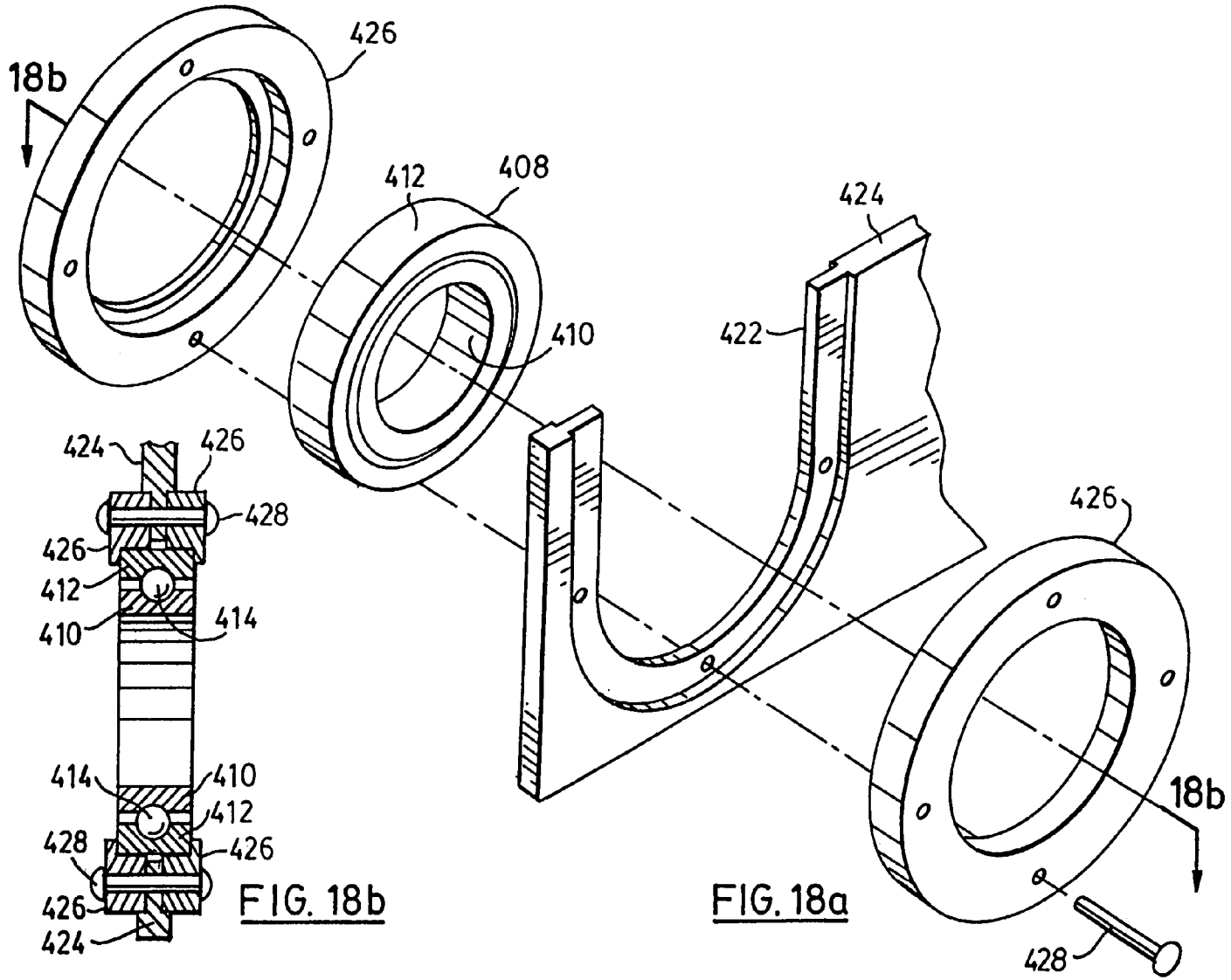
FIG. 18(*a*) is a perspective view of a cylindrical bearing and retaining plates used in the crankshaft assembly of FIG. 16.

Referring to FIGS. 18*a* and 18*b* the end of beam 424 has a cut-out section 422 and a bearing assembly 408 is held in the cut-out section by being clamped between two retaining discs 426 by fasteners 428 through holes in discs 426 and the beam. With the bearing assembly 408 attached to the shaft 400 (FIG. 16) and coupled to beam 424, when the motor drives shaft 400 (FIG. 16) the shaft and inner cylindrical portion 410 rotates over ball bearings 414 with respect to the outer section 412 driving each beam in a circular orbit about the center of the bearing attached to the beam with each beams being 90° out of phase with the preceding beam.

Figure 19:
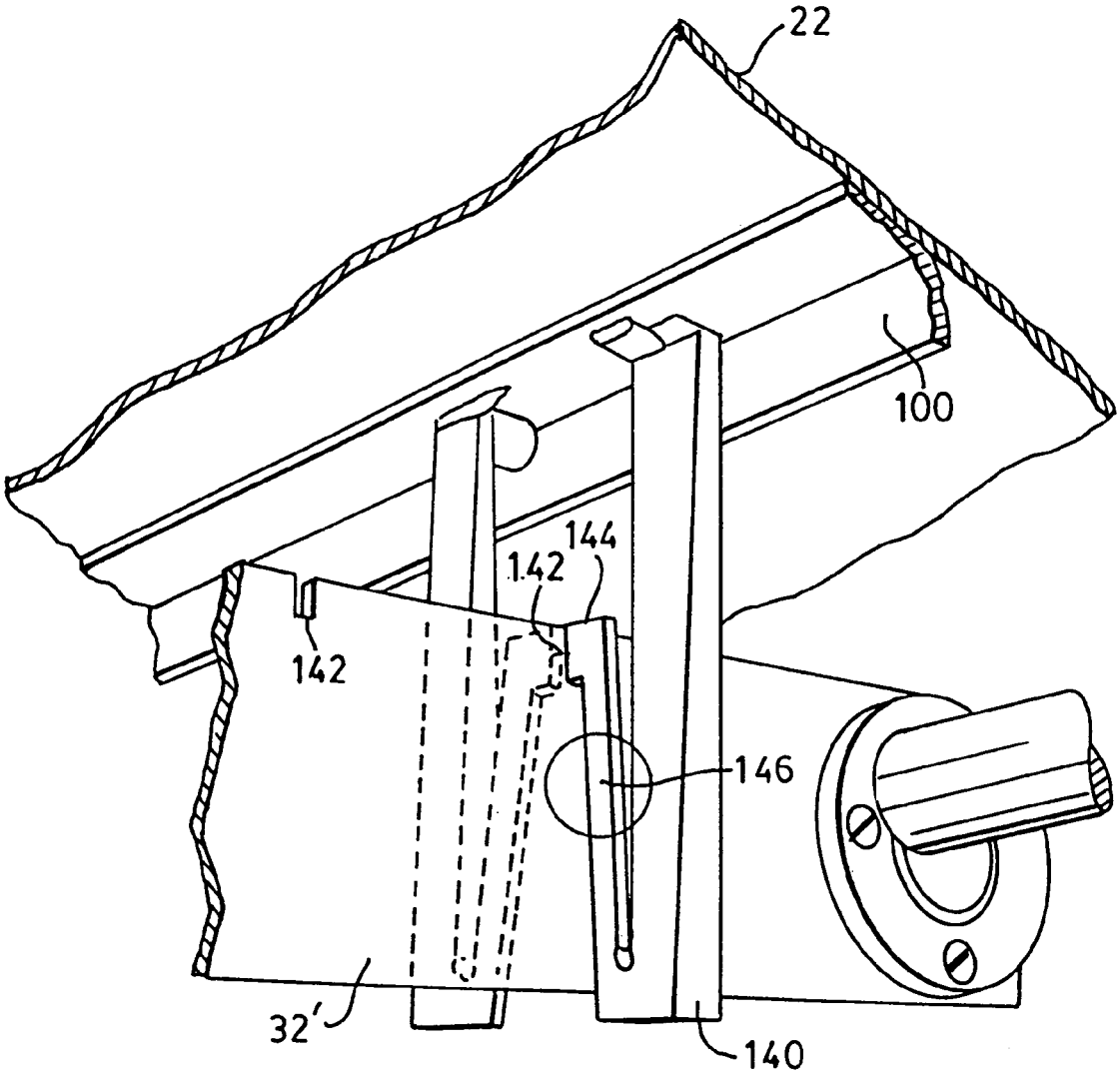
FIG. 19 is a perspective view, broken away, of an alternative embodiment of a connector for connecting a flexible sheet to a beam forming part of the present invention.

While the wave generating apparatus for generating waves in beds, chairs and the like has been described and illustrated with respect to the preferred embodiments, it will be appreciated by those skilled in the art that numerous variations of the invention may be made which still fall within the scope of the invention described herein. For example, because the links only pivot through a small angle, they may be replaced with flexible springs rather than rigid links pivotally connected to the beams. This further simplifies the design and reduces the part count. Referring to FIG. 19, the beams 32' are attached to ribs 100 by flexible spring members 140 thereby connecting the beams to flexible sheets 22. Slots 142 are cut out of the beam and a bracket section 144 of spring member 140 is inserted into the grove to form a friction fit thereby connecting the spring member to the beam. In operation as the beams are driven the springs 140 flex and the beams essentially pivot about the circled region 146.

Additionally, the rigid means may be replaced by a flexible power transmission such as a chain, wire, cable or toothed belt interconnecting and synchronously driving the links at the crank locations.

The elongate beams and flexible sheet may be contoured to follow an anatomical feature to produce for example an ergonometrically favorable device in which the planar flexible member would provide an anatomical support surface. The beams may be flexible to follow a variable curved path in either axis perpendicular to the trajectory of wave travel.

Figure 20:
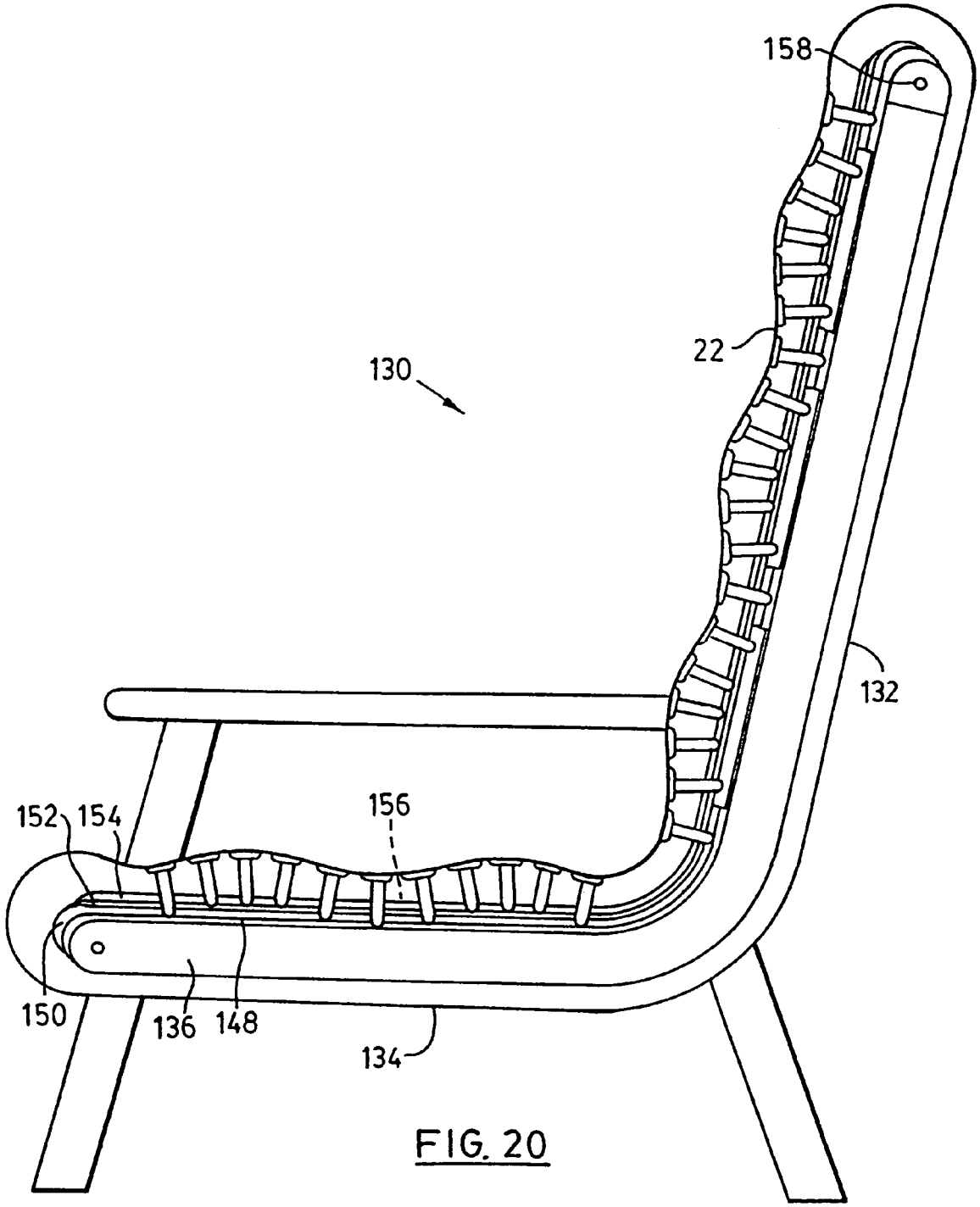
FIG. 20 is a cross sectional side elevation view of a wave chair produced in accordance with the present invention.

Referring to FIG. 20, a wave chair constructed in accordance with the present invention is shown generally at 130 having a back rest portion 132 and a seat portion 134. The beams 136, 148, 150, 152, 154 and 156 are generally L-shaped to provide back rest portion 132 and seat portion 134 with the beams being driven by a drive mechanism 158 similar to the mechanism 42 shown in FIG. 4. Because each point in each beam still undergoes circular motion (regardless of its shape) a traveling wave is produced down the back rest and along the seat portion 134 of chair 130. The chair could also be constructed similar to the bed 170 in FIG. 14 with the two sets of beams pivotally connected together with one set of beams corresponding to a backrest and the other to the seat portion of the chair. The crank and motor can be located at the pivotal connection point of the two sets of beams and idler cranks located at the free ends of each bank of beams. It will be understood that the motor may be attached to any of the cranks, with the non-driven cranks being referred to as idler cranks.

As mentioned above, the simplest possible wave generating apparatus according to the present invention would have a single rotating crank attached to an inertial anchor driving a single drive rod attached to the flexible sheet which generates a wave segment of less than one wavelength. When longer wave segments of one or more wavelengths are required, one or more beams becomes necessary. Therefore, a minimum of one beam is required to generate synchronized wave motion over one or more wavelengths, however, three beams or other synchronizing means such as a belt, chain or wire are necessary to impart rotary movement between the motor driven crank shaft and the idler crankshaft. A two beam mechanism has a point of instability when both the beams are aligned. In that position further rotation of the drive crank will not necessarily cause any rotation of the idler crankshaft. When the two beam system is aligned at the point of instability, the mechanism may lock up or the idler crank may counter-rotate. In a system with at least three beams the beams are never all aligned and are forced to remain parallel, hence there is no point of instability.

Figure 21A:
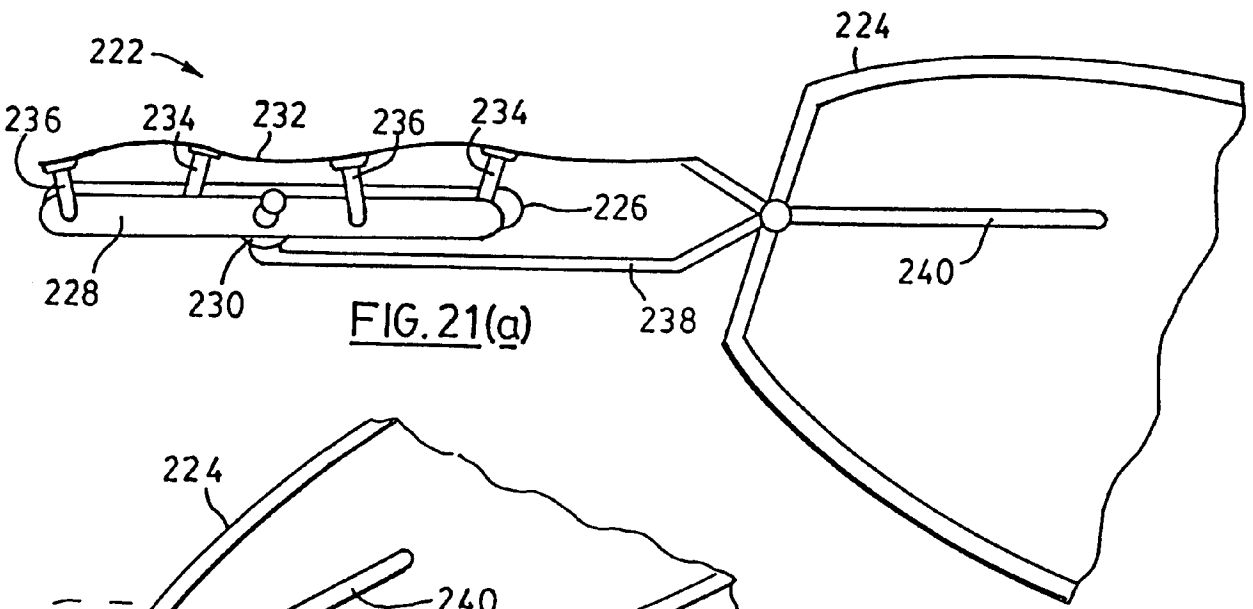
FIG. 21(*a*) is a plan view, broken away, of a boat and wave generating device as a rudder.
Figure 21B:
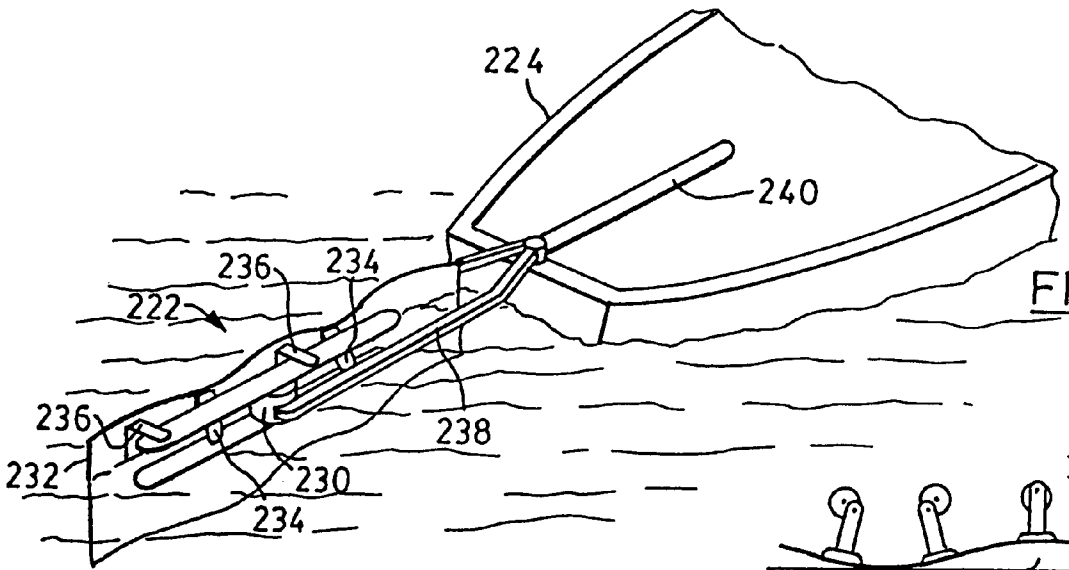

FIGS. 21(*a*) and 21(*b*) show the wave generating mechanism of the present invention being used to construct a self-propelling rudder 222 for a propulsion system for a boat 224. The self-propelling rudder comprises two beams 226 and 228 with a drive motor and crankshaft assembly 230 driving the two beams and producing sinusoidal wave motion on flexible sheet 232 connected to the beam 226 by at least two drive rods 234 and connected to beam 228 by at least two drive rods 236. A motor mounting beam 238 is connected to boat 224 for supporting the motor and crank assembly. Most of the flexible sheet 232 is submerged in the water and also acts as a rudder with the rudder 222 pivotally connected to boat 224 at 238 and hand operated by a tiller 240. The motor/crankshaft mechanism 230 is located above the water line so that only the thin flexible sheet 232 is immersed in order to minimize drag. Applications include all those in which propellers are used in water, air or other media. Again, when only one wavelength is sufficient, only one beam is required, and if less than one wavelength is sufficient, then no beam is required.

A system with a single crank is under constrained in that the shape of the s wave is not necessarily sinusoidal. By pushing down on one end of the flexible sheet, the other end lifts and the wave distorts. This can be an advantage in the case of a propulsion system based on the present wave generating device. In a propulsion system the wave takes on a shape of least resistance to the water so that more of the wave energy goes directly into propulsion. This produces a wave motion that can vary in shape and amplitude along its direction of travel.

Figure 22:
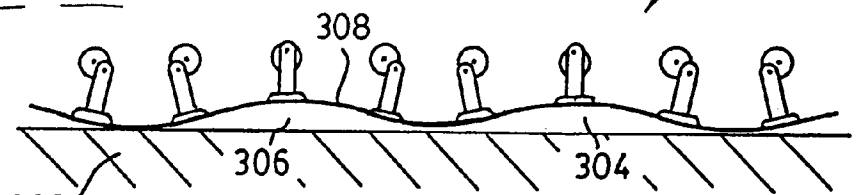
FIG. 22 shows an alternative embodiment of a wave generating device according to the present invention.
Figure 31:
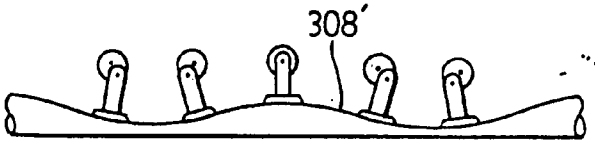
FIG. 31 shows a further alternative embodiment of a wave generating device.

FIG. 22 shows a wave generating device 300 adjacent to a surface 302 so that when the device is operating the cavities 304, 306 formed between the flexible membrane 308 and the flat surface moves with the wave. In this configuration the system acts like a peristaltic pump. When combined with the feature of FIGS. 13(*a*) and 13(*b*), the volume of cavities 304 and 306 can be varied along the wave path, thereby compressing or decompressing the fluid as in an air compressor or vacuum pump. Peristaltic pumping through a flexible tube could be achieved for example by replacing flexible sheet 308 with a flexible tube 308', see FIG. 31. The flexible member may also be part of the human body such as a calf, thigh, torso or arm or an existing element of another apparatus. Therefore it will be appreciated that the present invention provides a way of producing transverse waves in any flexible member and is not restricted to planar sheets.

Traveling transverse waves are defined as waves in which the wave disturbances move up and down while the waves move in a direction at right angles to the direction of the disturbance. The transverse wave generating mechanism comprises a flexible member defining a wave surface and at least one right angle projection (links) from the wave surface to a pivoting point of attachment to at least one local crank. To produce transverse traveling waves one of one or more wavelengths multiple right angle projections from the flexible member to pivoting points of attachment are synchronously driven by local cranks. The oscillatory motion of the end portion of each link member pivotally attached to the beam is in a plane defined by orthogonal axes, with one axis being parallel to the direction of travel of the transverse wave travel and the other being parallel to the direction of the wave disturbance which by definition is perpendicular to the direction of wave travel.

Figure 11:
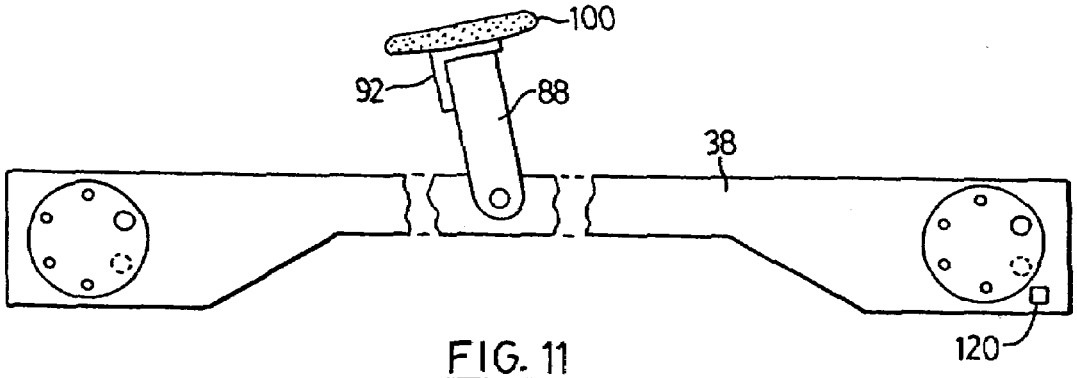
Figure 12:
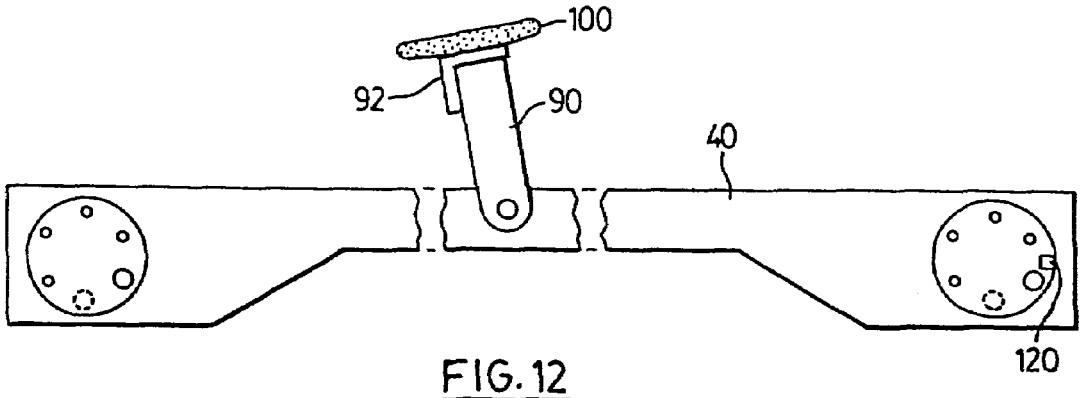

The projection from the wave surface is selected so that the locus of movement of the endpoint of this projection is almost circular. FIG. 22 shows this most clearly. In FIG. 11 elements 100, 92 and 88 collectively constitute the projection of the wave surface 22 to the distal pivot point on the beam 38. The links used in the bed and chair are a specific means of constructing a rigid projection from the planar surface of the wave surface. For very small amplitudes, (±a) relative to the wavelength (w), i.e. $a \ll w$, the locus is almost exactly circular. For amplitudes $a<w/10$, typical of beds and chair applications disclosed herein, the locus is non-circular, therefore a crank driven in a circular path will produce a pseudo-sinusoidal wave, in other words, not exactly a sinusoidal wave but nevertheless functionally equivalent to a sinusoidal wave.

For larger relative wave amplitudes, the crank must be driven through a non-circular arc at a non-linear speed otherwise distortions of the wave surface may become too large to maintain a functional wave profile. The non-linear rotating speed may become necessary because, for larger amplitudes, the end of the projection may move significantly faster at certain times in its phase trajectory than at other times.

The fact that a projection of a wave surface goes through a point where the locus is pseudo-circular and at a pseudo-constant rate of rotation, within limited ranges of relative wave amplitude, is key to the functioning and limitations of this mechanism. Supplementary synchronizing means, not rotatably coupled to the crankshaft or to any counter rotating mechanically coupled elements, may be attached to any projection of the wave surface to synchronize wave movement provided that the points of connection are in phase. These arbitrary points of attachment need not be moving in any psuedocircular path in order to provide synchronous coupling between points of attachment nor do they need to be mechanically driven or coupled to other elements. A supplementary synchronizing means may be an additional beam, wire, cable or chain.

The drive beams (one or more) are optional. They are means for synchronizing two or more local cranks that are in phase with one another and are arguably the simplest way of driving several of these local cranks from a single source. A single crank, when driving a linear drive bar, effectively provides a very convenient way of delivering the crank rotation to any other point of attachment, and specifically to those projected points of attachment where the locus of the wave projections are pseudo-circular. The drawback of this method of synchronizing cranks is that it may be inflexible. The wave must follow a prescribed path unless sections of the wave are decoupled with flexible elements. A gear motor could in principle be attached at every crank location and electronically synchronized to generate the wave. In this embodiment there may be a flexible wave path. The local cranks may also be coupled with belts, wires, cables, chains or other functionally similar elements and thereby synchronously driven from a common source.

It will also be understood that all the drive bars need not be driven from a common crankshaft. Uncoupled drives bars are preferred for higher relative wave amplitudes so that the individual bars may be driven through more precise loci and angular speeds that are phase adjusted. For a high powered, high amplitude wave propeller this configuration would be preferred.

Referring to FIGS. 23 to 26, an embodiment of an apparatus for generating waves with variable amplitude is shown generally at 600. The variable amplitude wave generating device includes flexible sheet 602 in which the transverse waves are developed. Two synchronizing beams 604 and 606 have several links 608 each pivotally attached at one end thereof to the beam and rigidly attached at the other ends thereof to the flexible sheet 602. The links 608 are spaced along each beam with the spacing of the links determining the wavelength of the transverse waves generated in sheet 602. A gear motor 610 is rigidly attached to beam 604 and the motor has a rotary output drive 612. The mechanism includes a variable amplitude crank mechanism including a plate 614 rigidly connected to output drive 612 of the gear motor 610 so that plate 614 rotates with the output drive. A bearing plate 616 includes a shaft 620 and a handle 622 and a center channel 624 extending down the shaft. Shaft 620 passes through a bearing 419 located in a hole through beam 606 and plate 616 is free to rotate with respect to beam 606.

Figure 24:
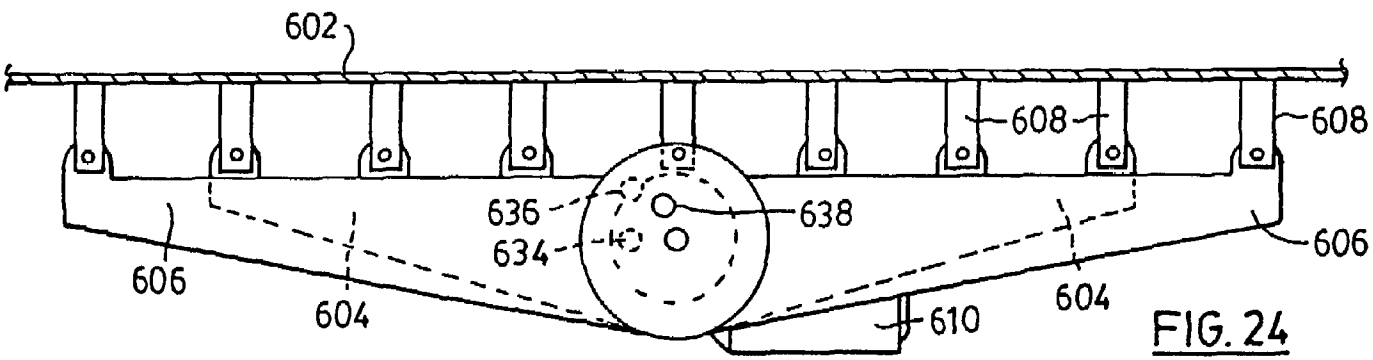
FIG. 24 is a view along line 24-24 of FIG. 23 with the device stationary.
Figure 26:
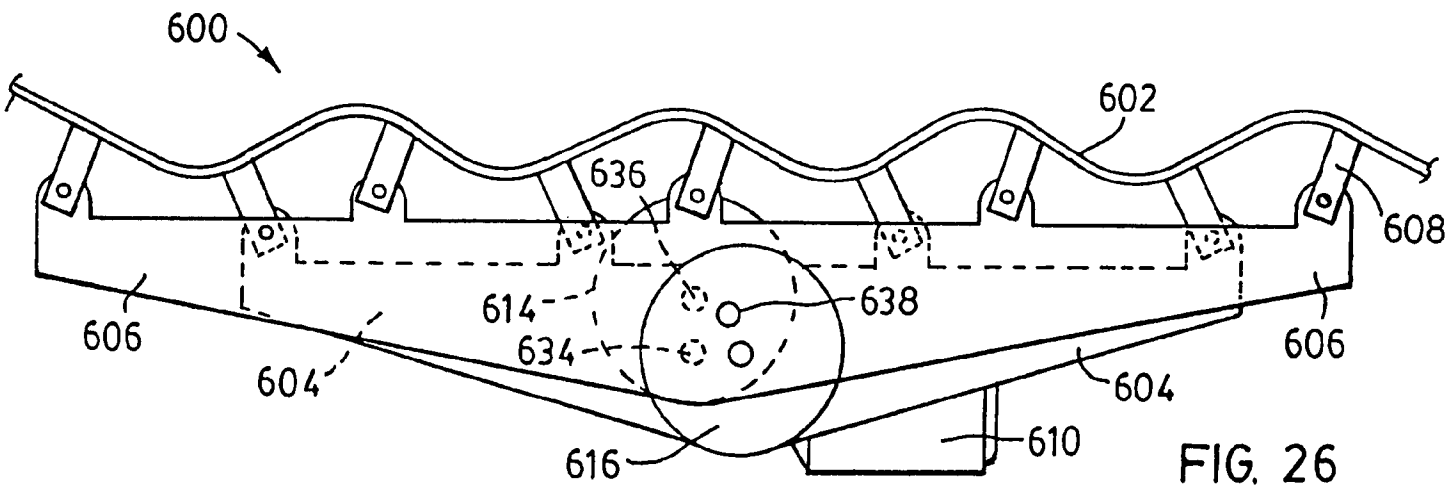
FIG. 26 is a view along line 24-24 of FIG. 23 with the device in operation.

Plates 614 and 616 are pivotally attached by a pin 626 extending through holes in both plates that are offset from the centers of the plates. Thus pin 626 defines a pivot point for rotation of plates 614 and 616 with respect to each other. Plate 614 includes a hole in the center of the plate and a locking pin 628 located in shaft 620 is shown engaged through the center holes of each plate so that the sheet is flat as shown in FIG. 24. Locking pin 628 includes a hand grip 630 for retracting the pin from the plates. Referring specifically to FIG. 26, plate 614 includes several holes 634, 636 and 638 large enough so locking pin 628 can be inserted in each hole.

Figure 23:
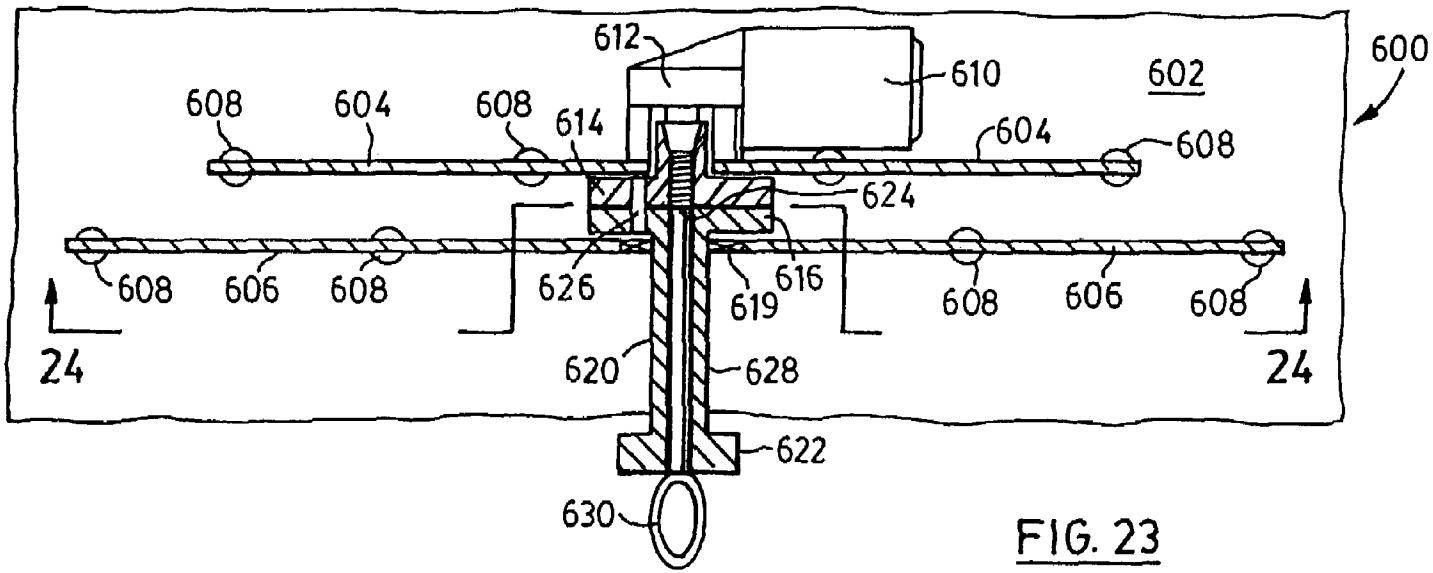
FIG. 23 is a cross sectional view of an alternative embodiment of a wave generating apparatus.
Figure 25:
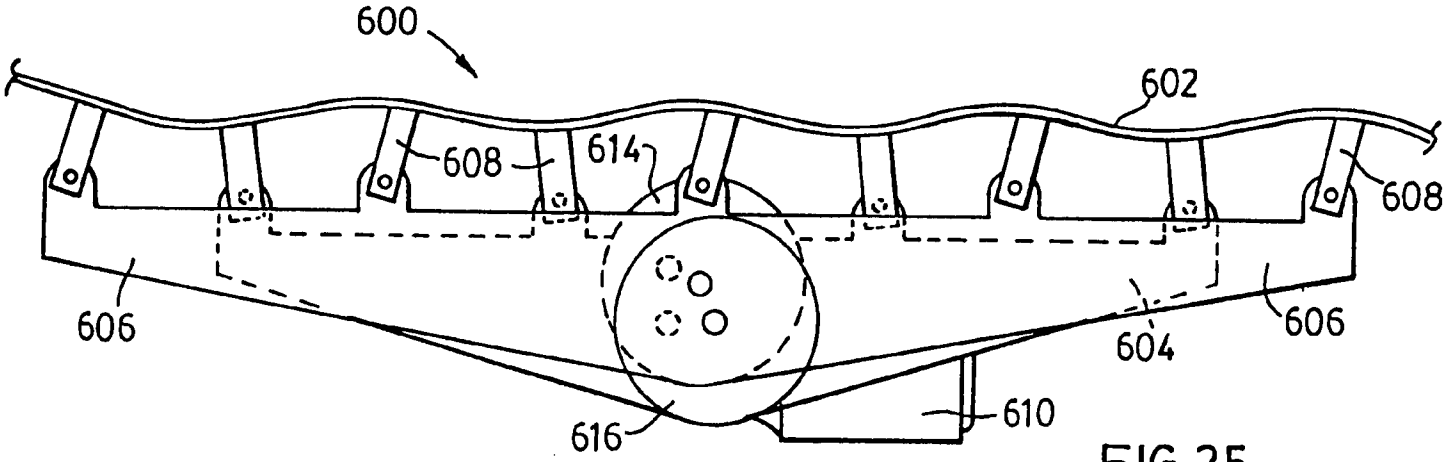
FIG. 25 is a view along line 24-24 of FIG. 23 with the device in operation.
Figure 27:
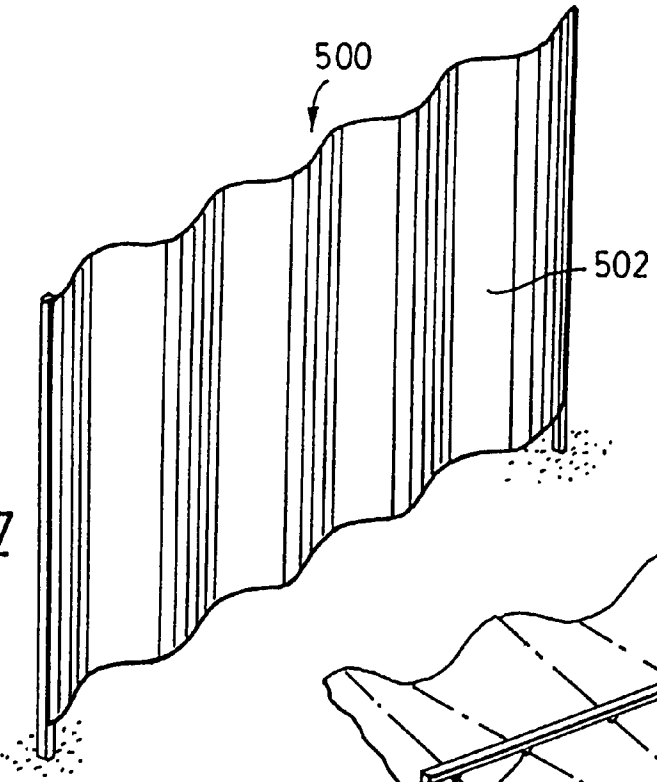
FIG. 27 shows an alternative embodiment of a wave generating apparatus with the wave surface acting as a moving billboard or projection screen.

When the plates 614 and 616 are aligned concentric with each other by locking pin 628 engaged in the center holes of each plate as shown in FIGS. 23 and 24, the flexible sheet 602 is flat. Referring now to FIGS. 26 and 27, the amplitude of the transverse wave generated in the sheet 602 is adjusted by pulling on handgrip 630 to retract pin 628 from the center holes of plates 614 and 616. Once the plates have been unlocked and can rotate with respect to each other, handle 622 is rotated so plate 616 rotates with respect to plate 614 about the pivot point defined by pin 626. Plate 616 is rotated until its center hole 624 (FIG. 23) lines up with one of holes 634, 636 and 638 in plate 614 (FIG. 24) after which pin 628 is inserted into the hole thereby locking the plates together. Upon rotating handle 622, beam 606 pivots with respect to beam 604 to produce a wave in sheet 602 with the amplitude of the wave being dependent upon which hole in plate 614 is aligned with the center hole plate 616. The more handle 622 is rotated the greater the amplitude. FIGS. 25 and 26 show increasing crank offsets with proportional increases in wave amplitude. When gear motor 610 is engaged the output drive 612 rotates bearing plate 614 which also drives plate 616. Since plate 616 is non-concentric with respect to plate 614, plate 616 rotates in a circle about the rotational axis of output drive 612 which produces circular motion in that portion of beam 606 about the hole through which the shaft 620 passes. All points on the beam therefore undergo circular motion. Since beam 604 is also connected in the same way to sheet 602 as beam 606, all points of the beam are forced to simultaneously undergo circular motion as well but with a phase difference relative to beam 604 so that transverse waves are generated in sheet 602.

The embodiment of the variable amplitude wave generating mechanism shown in FIGS. 23 to 26 uses increasing crank offsets to achieve increasing amplitude of the transverse waves. The offset is achieved through coupling two discs off center and rotating one relative to the other. It will be understood that various other methods, such as cams, slider cranks and springs may be used for achieving the same result.

FIG. 27 shows a billboard device at 500 using the wave generating device disclosed herein with the wave surface 502 acting as a moving billboard, mirrored surface or projection screen. Using the wave generating device permits the production of a moving image from a static image or the production of holographic or 3D imagery. Coating the wave surface with a holographic motif produces a visually interesting and eye catching result.

Figure 28:
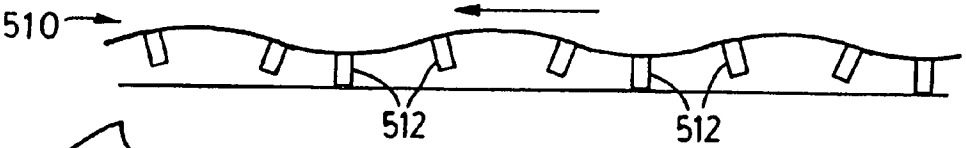
FIG. 28 shows another alternative embodiment of a wave generating apparatus with the wave surface combined with walking feet.

FIG. 28 shows the wave generating device 510 combined with walking feet 512 so that in operation the device essentially "walks"in the direction of the traveling waves indicated by the arrow. The walking feet at 512 represent projections of the wave surface to points of contact to a surface such as the ground. The endpoints of the feet 512 move opposite to the direction of wave travel at the point of contact and reverse direction as they lift from the surface, giving rise to a walking or caterpillar type of movement in the direction of wave travel.

FIG. 29 shows the present wave generating device 520 provided with flexible beams 522 and 524 and a changing wave trajectory.

Figure 30:
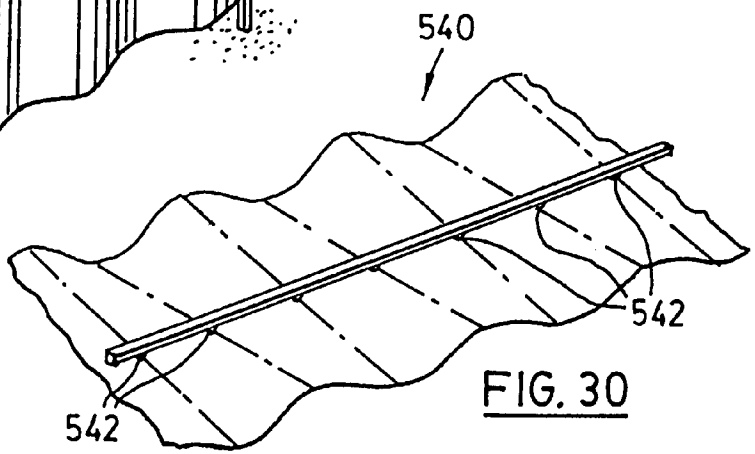
FIG. 30 shows an alternative embodiment with the wave movement translated through pivot points to create a mirrored projection through a bulkhead.

FIG. 30 shows an alternative embodiment of a wave generating apparatus at 540 with the wave movement translated through pivot points 542 to create a mirrored projection of the wave through a bulkhead.

It will be understood to those skilled in the art that there is tremendous flexibility in how the basic aspects of this invention can give rise to a very broad range of possible embodiments and applications and that the embodiments contained herein are only a few among numerous possibilities.

For example, as discussed previously, attaching the drive motor directly to the flexible sheet rather than directly to one of the beams very advantageously eliminates the need for more than one rigid beam, adds an additional point of attachment to the flexible sheet and reduces the packaging size and number of parts required.

Figure 32D:
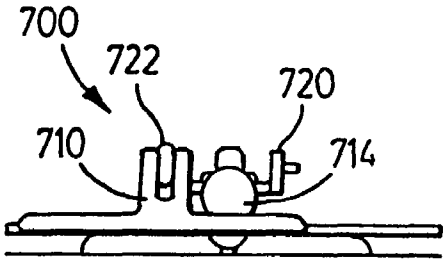
FIG. 32*d* is an end view of the device of FIG. 32*a* taken along arrow C of FIG. 32*c;*
Figure 32A:
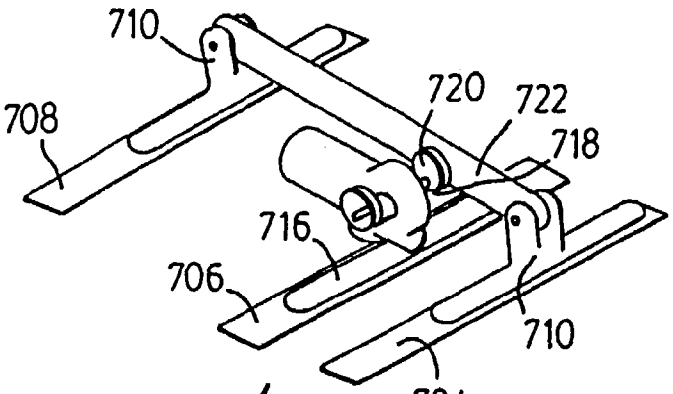
FIG. 32*a* is perspective view of a single beam wave generating device.
Figure 32C:
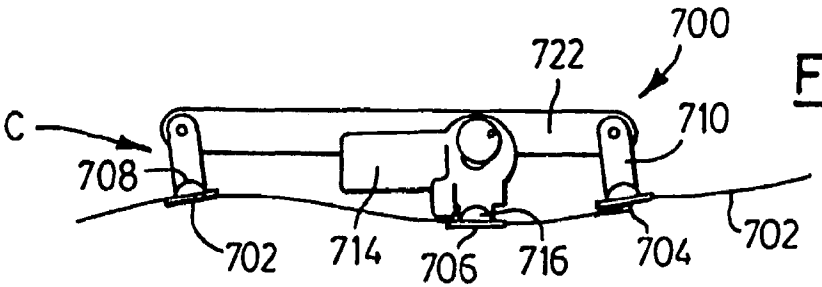
FIG. 32*c* is a side view of the device of FIG. 32*b;*
Figure 32B:
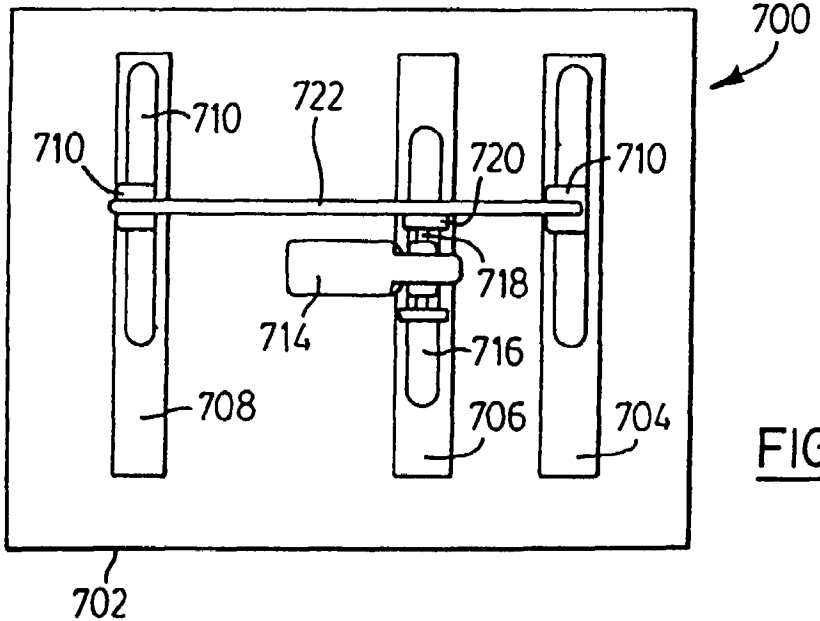
FIG. 32*b* is a top view of the device of FIG. 32*a* including the flexible sheet in which the waves are produced.

Referring to FIGS. 32*a,* 32*b,* 32*c* and 32*d,* a wave generating mechanism constructed with only one rigid beam is shown generally at 700. This mechanism comprises a flexible sheet 702 (FIG. 32*b*) and three spaced ribs 704, 706 and 708 rigidly affixed to the sheet 702 with the outer two ribs 704 and 708 having link members 710 rigidly secured to the respective ribs and extending perpendicular from the surface of the flexible sheet. A gear motor 714 is rigidly secured to middle rib 706 by a rib attachment 716 which has the effect of securing the gear motor 714 to the flexible sheet 702. The output shaft 718 of gear motor 714 drives a crank shaft 720 which engages a single rigid beam 722 so that motor 714 drives beam 722 in circular rotational motion. Beam 722 is pivotally connected to links 710 on ribs 704 and 708.

As mentioned previously, a significant advantage of attaching the motor 714 directly to the flexible sheet 702 rather than directly to the beam 722 is that the assembly is more compact and a single oscillating beam mechanism becomes possible. The motor rib attachment assembly 716 adds one additional point of attachment to the wave sheet 702. With the gear motor 714 anchored directly to the flexible sheet 702, it can drive the single beam 722. In addition, the motor, as part of the rib assembly can be located very close to the surface of the flexible sheet thus allowing the device to be made as thin as possible.

Figure 33A:
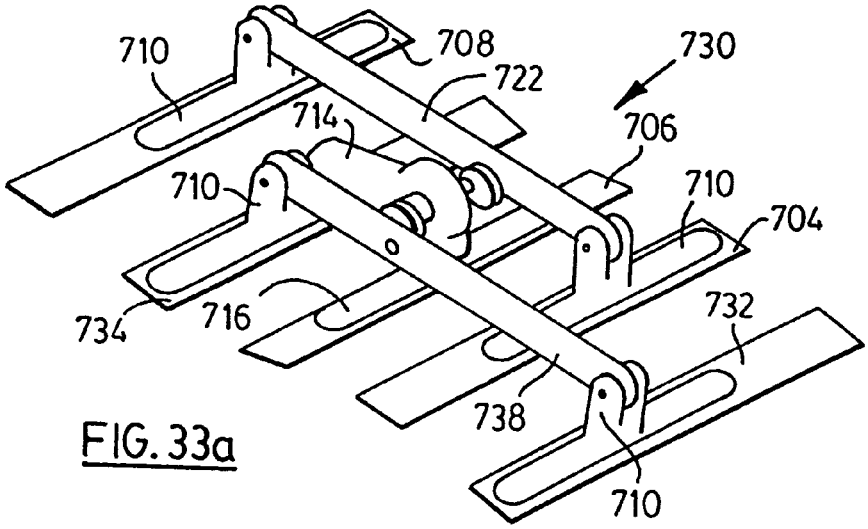
FIG. 33*a* is perspective view of a double beam wave generating device.
Figure 33B:
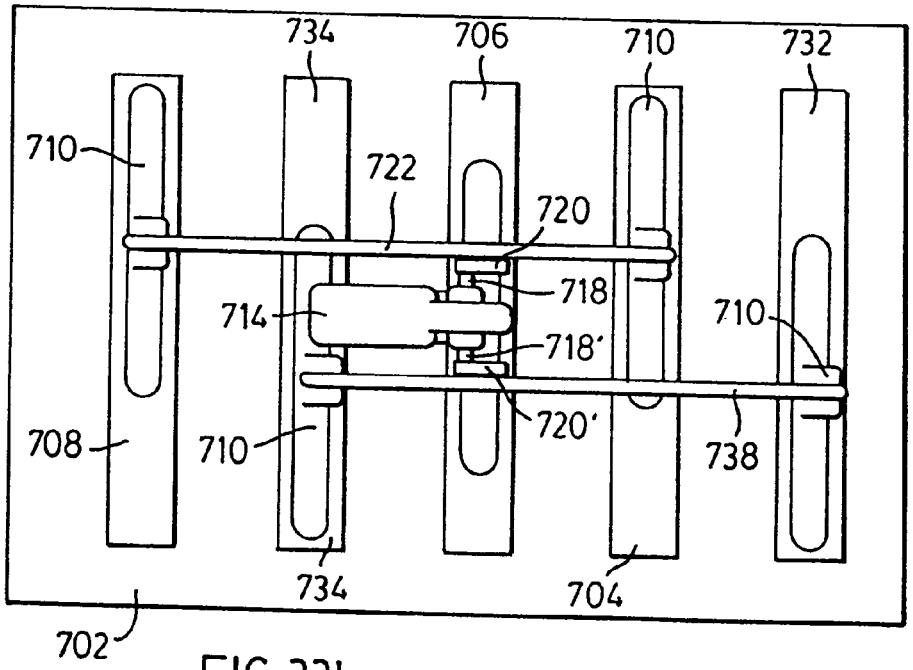
FIG. 33*b* is a top view of the device of FIG. 33*a* including the flexible sheet in which the waves are produced.
Figure 33C:
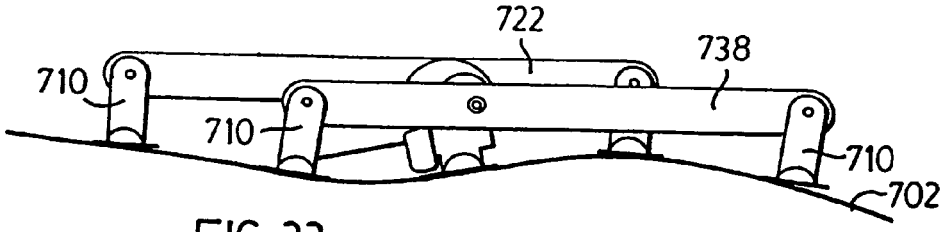
FIG. 33*c* is a side view of the device of FIG. 33*b;*

The single-beam wave-generating mechanism of FIGS. 32*a* to 32*d* can be readily modified to produce a two and three-beam wave-generating mechanism. Referring to FIGS. 33*a,* 33*b* and 33*c,* a two-beam device shown generally at 730 includes two additional ribs 732 and 734 each having a link 710 attached thereto and a second rigid beam 738 pivotally attached at its opposed ends to the links 710. A second output shaft 718' of gear motor 714 drives a second crank shaft 720' on the other side of motor 714 which is attached to the second rigid beam 736 so that motor 714 also drives beam 738 in circular rotational motion but at a different phase with respect to the rotational motion of beam 722.

Figure 34A:
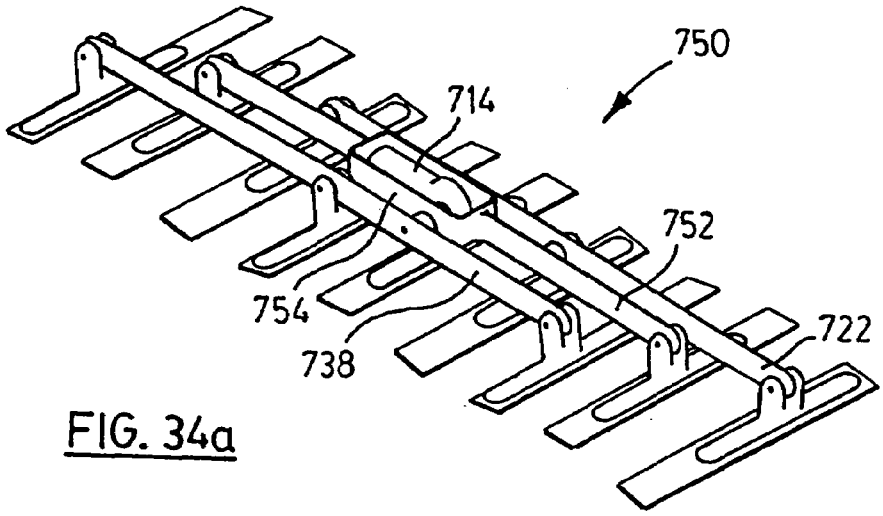
FIG. 34*a* is perspective view of a double beam wave generating device.
Figure 34B:
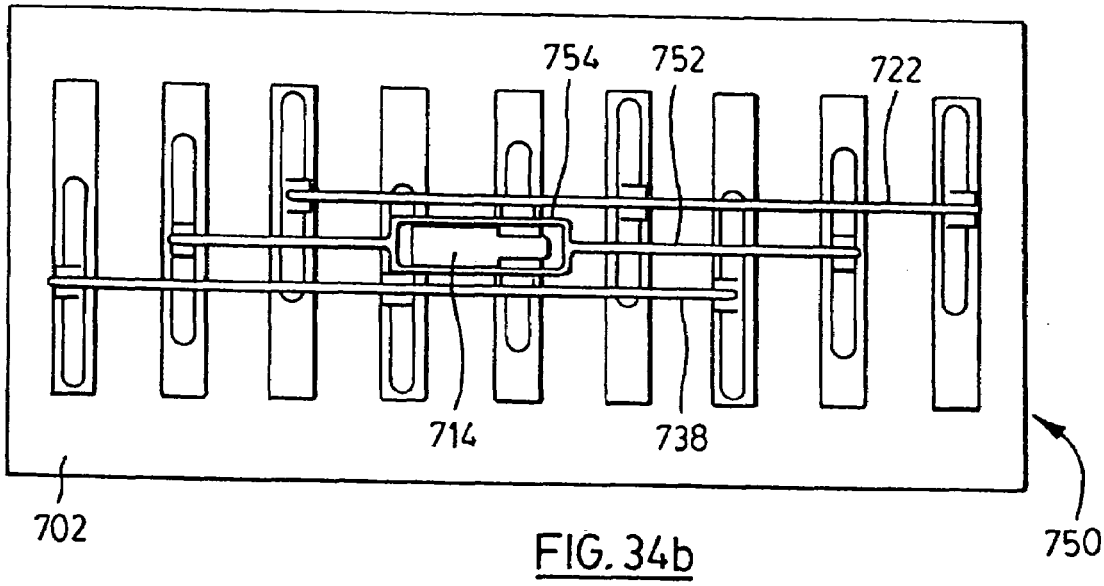
FIG. 34*b* is a top view of the device of FIG. 34*a* including the flexible sheet in which the waves are produced.

A three beam embodiment of a wave-generating mechanism is shown in FIGS. 34*a,* 34*b* and 34*c* at 750 and includes a third beam 752 which may be pivotally attached to any part of gear motor 714. FIGS. 34*a* and 34*b* show beam 752 with a rectangular frame section 754 in which motor 714 is housed and pivotally attached to the sides of motor 714. While motor 714 is shown in a concentric relation with beam 752 it will be understood that it does not need to be concentric.

Figure 35A:
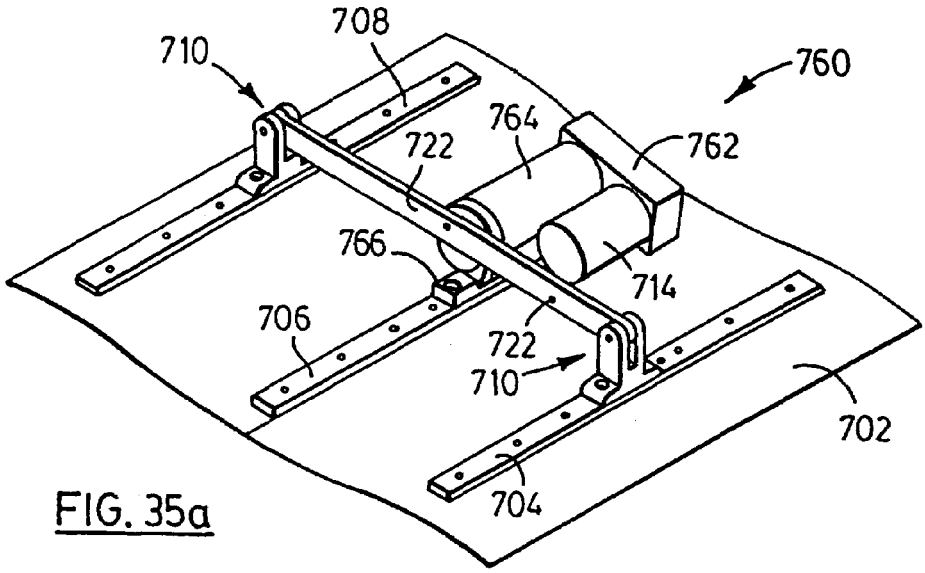
FIG. 35*a* is perspective view of another embodiment of a single beam wave generating device.
Figure 35B:
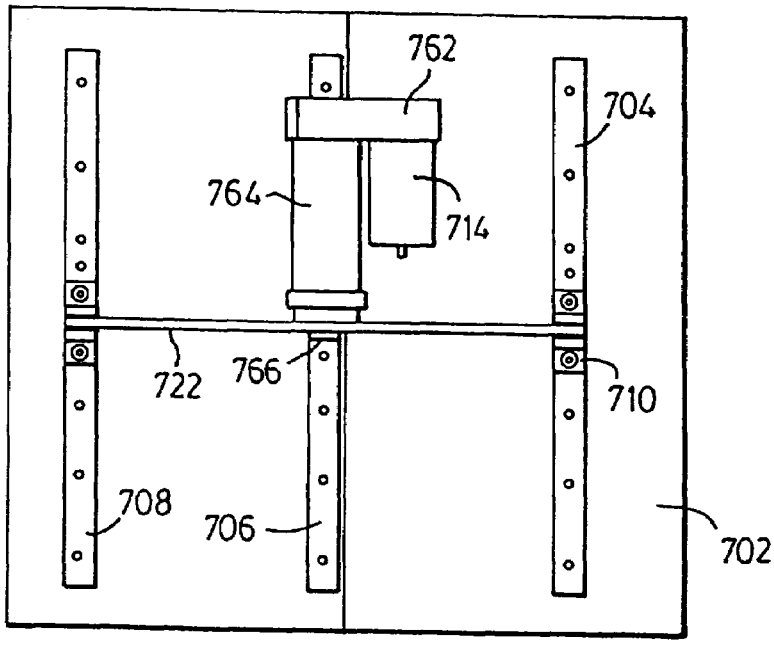
FIG. 35*b* is a top view of the device of FIG. 35*a* including the flexible sheet in which the waves are produced.
Figure 35C:
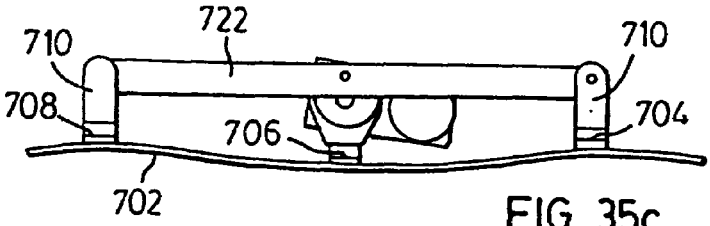
FIG. 35*c* is a side view of the device of FIG. 35*b;*

Referring to FIGS. 35*a,* 35*b* and 35*c* an alternative wave generating mechanism constructed with only one rigid beam similar to mechanism 700 in FIGS. 32*a* to 32*d* is shown generally at 760. In mechanism 760 gear motor 714 is attached to a belt housing 762 which houses a belt (not shown) which couples motor 714 to a planetary gear reducer 764. The planetary gear reducer 764 is rigidly secured to central rib 706 by a rib attachment 766 which has the effect of rigidly securing the gear motor 714 to the flexible sheet 702. The output of the planetary gear reducer 764, driven by gear motor 714, is attached to beam 722 so that motor 714 drives beam 722 in circular rotation motion. Rib 706 is equally spaced from beams 704 and 708 while in mechanism 700 in FIG. 32*a* rib 706 is much closer to rib 704.

The advantage of spacing the center rib 706 evenly between the outer ribs 704 and 708 is to provide an even distribution of support to the wave surface 702 and to provide an even distribution of torque to the drive motor 714, however the asymmetric one beam system of FIG. 32 is advantageous when it is inconvenient to locate the drive motor 714 in the center, as may be the case when the wave generating device needs to be integrated with other mechanical components such as seat adjustment or lumbar support mechanisms.

Figure 36B:
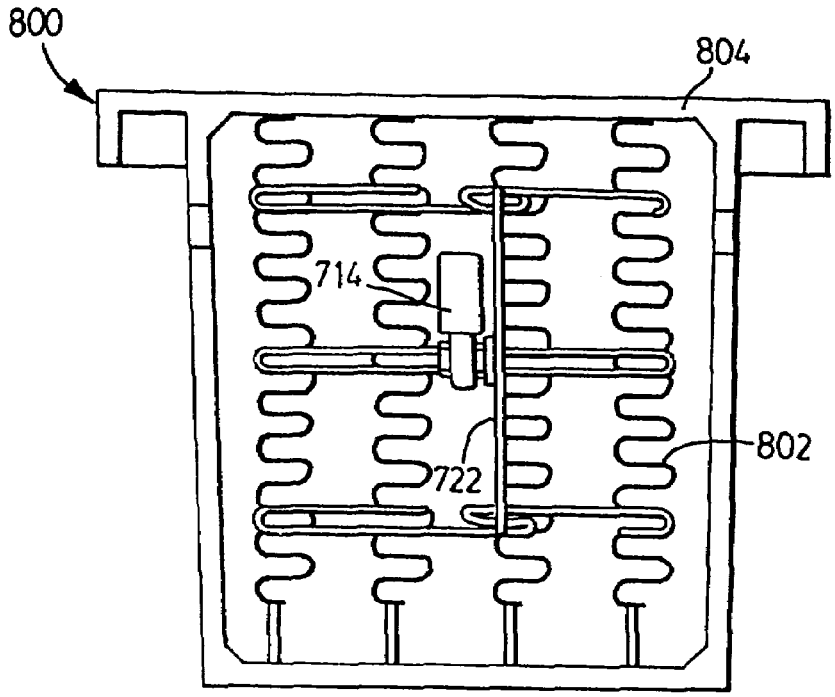
FIG. 36*b* is a front elevational view of the device of FIG. 36*a;*
Figure 36A:
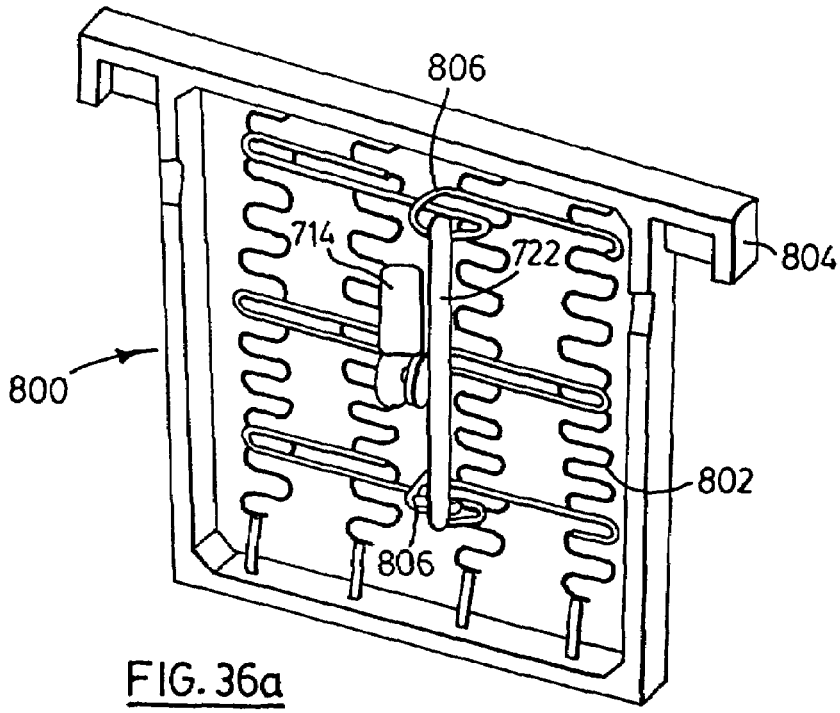
FIG. 36*a* is a perspective view of a spring system connected to a single beam wave generating device of FIG. 32*a* or 35*a;*

It will be appreciated that the flexible sheet in which the wave motion is produced need not be a continuous sheet. Referring to FIGS. 36*a* and 36*b*, a single beam wave-generating mechanism similar to mechanism 700 (FIG. 32*a*) is shown at 800 wherein the flexible sheet is a spring assembly 802 for use in for example a bed or chair. Spring assembly 802 is attached to a frame 804 which may be a bed or chair frame. The ends of beam 722 are attached to wire loops 806 which are rigidly attached to spring assembly 802. This spring assembly 802 is typical of conventional furniture support construction and can be integrated directly as a planar wave surface, eliminating the need for a separate planar sheet and the complications of integrating the two. There is also a cost saving to using an existing spring assembly as the planar wave surface of the wave generating mechanism. The ribs shown in this embodiment are also wire forms and easily attached to the spring assembly using off-the-shelf assembly components.

Figure 37B:
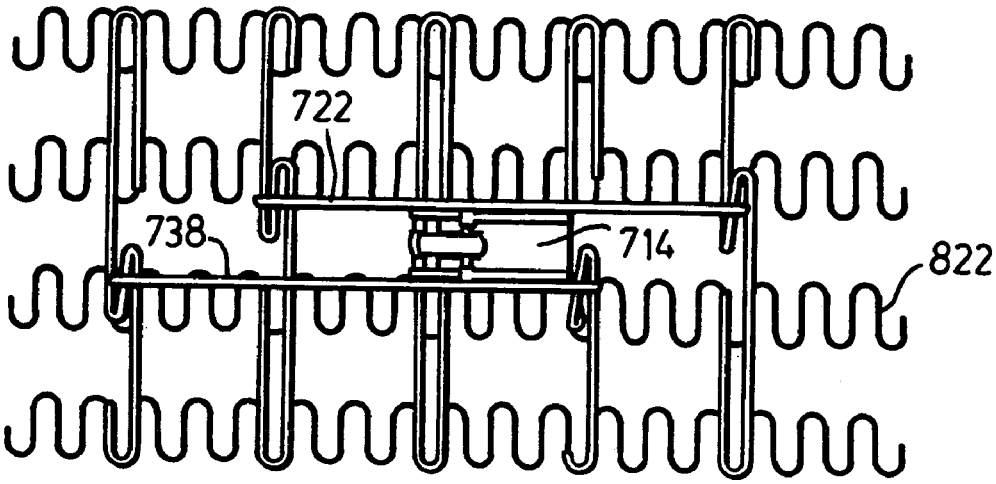
FIG. 37*b* is a top view of the device of FIG. 37*a;*
Figure 37C:
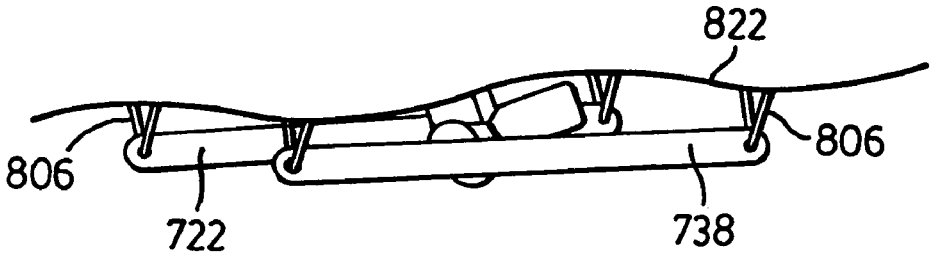
FIG. 37*c* is a side view of the device of FIG. 37*a;*
Figure 37A:
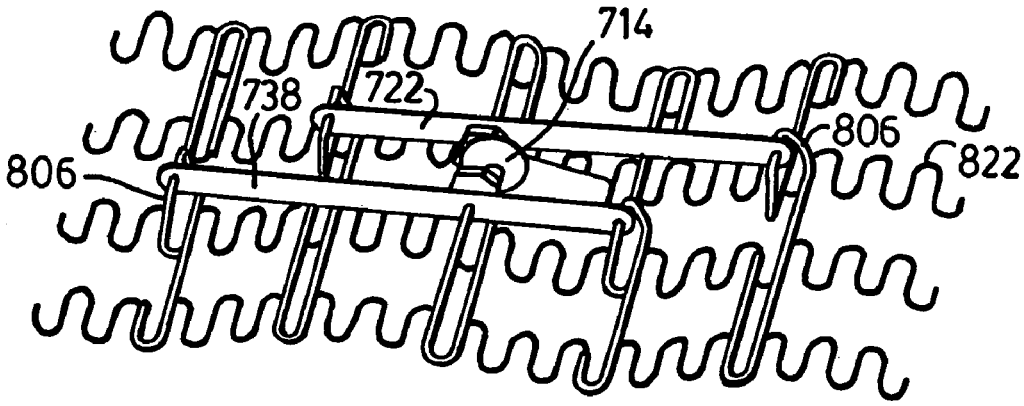
FIG. 37 is a perspective view of a partial spring system connected with a single beam wave generating device showing the generated waves.

FIGS. 37*a,* 37*b* and 37*c* show a two-beam wave-generating mechanism similar to mechanism 730 (FIG. 33*a*) is shown at 820 wherein the flexible sheet is a spring 822 with the beams 722 and 738 attached to spring 822 by wire loops 806. Gear motor 714 is similarly attached to the underlying spring by loops, not shown. The single beam system is preferred when the wave traverse is short (a single wave) whereas the two (or multi) beam embodiments is required for the generation of multiple wavelengths.

Figure 38A:
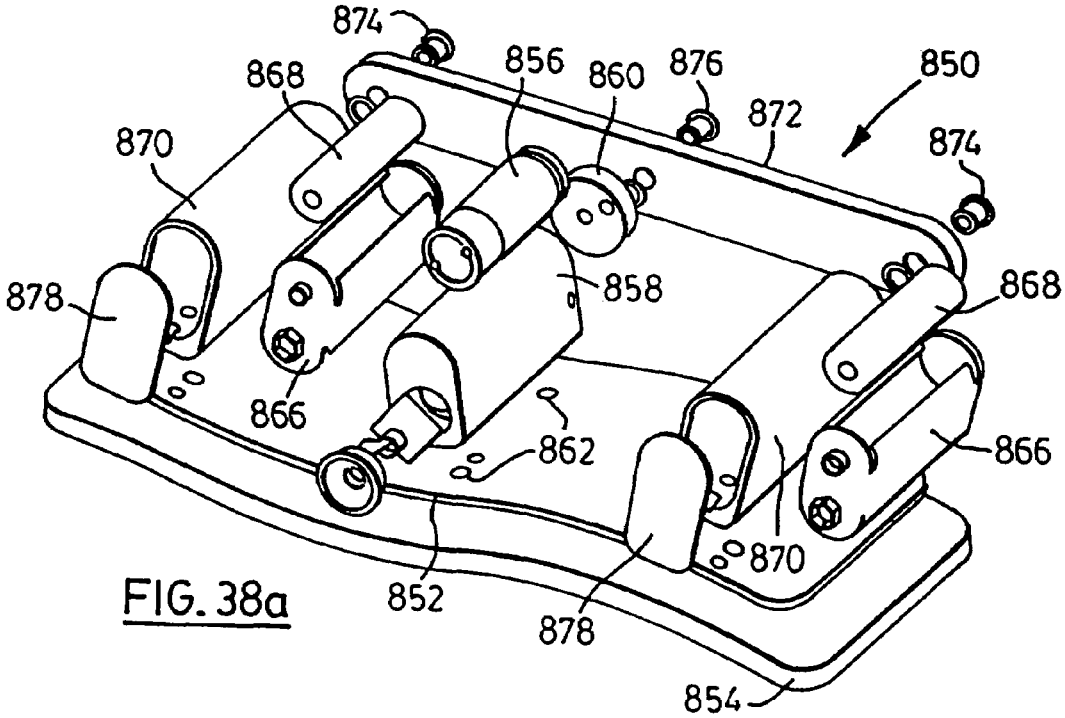
FIG. 38*a* is a disassembled view of a wave generating device for use as a peristaltic pump which can be worn by a person.

Referring to FIG. 38*a,* a single beam wave generating mechanism is shown generally at 850. Mechanism 850 is a portable, battery operated device is and includes a flexible wave sheet 852 having a thin pad 854 attached to the outer side of sheet 852. The gear motor 856 is located in motor housing 858 and its output shaft (not shown) is connected to cam 860. Motor housing 858 is secured to flexible sheet 852 and the bolt holes 862 can be seen in sheet 852. Two battery housings 866 hold batteries 868 which are electrically connected to motor 856 (wiring not shown). Battery housings 866 fit inside housings 870 which are secured to sheet 852 in the same way as motor housing 858 and A single, rigid beam 872 is pivotally connected at its opposed end portions to the ends of battery housings 866 by pins 874 and cam 860 is pivotally attached to beam 872 by way of pin 876 through beam 872 into cam 860. End plates 878 seal the battery housings.

Figure 38B:
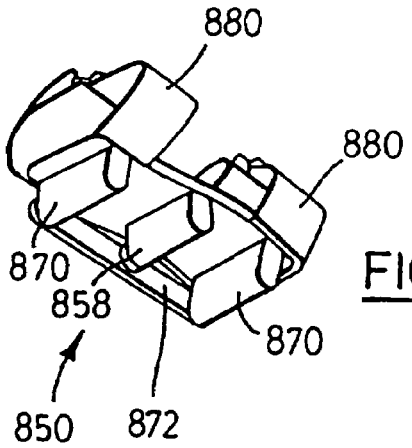
FIG. 38*b* is a perspective view of the device of FIG. 38*a* assembled.
Figure 38C:
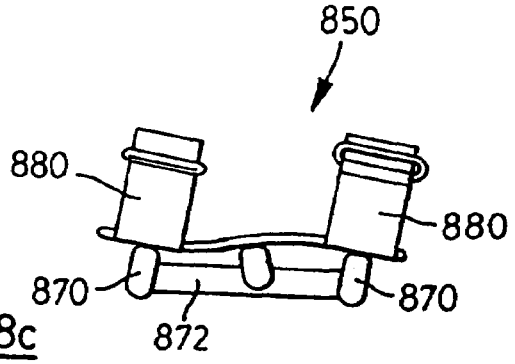
FIG. 38*c* is a side view of the device of FIG. 38*b;*

Referring to FIGS. 38*b* and 38*c,* wave generating mechanism 850 includes a pair of straps 880 for securing the device to a person's leg with the pad 854 against the person's calf. This wave generating mechanism 850, when in direct contact or attached to a part of the body, acts as a wearable peristaltic pump, pushing blood (and/or other bodily fluids) in the soft tissues in the direction of wave travel. The preferred direction of wave travel is in the same direction that blood normally flows in the body, namely toward the heart. The preferred place of attachment to the body is the back of the calf (secondarily, the underside of a foot or on the thigh) where blood normally pools and where deep vein thrombosis is most likely to originate when a subject is immobilized in a seated or sleeping position for a prolonged period of time. This process has been called 'economy class syndrome' in connection with thrombosis resulting from prolonged immobilization from long flights, though the effect occurs in all situations where a subject is immobilized for a long time in any position, and is a major problem following orthopedic surgery. At slow wave speeds, device 850 acts to maintain normal physiological blood flow that is otherwise provided by normal bodily movement. At higher wave speeds it may increase and enhance blood flow and act as an assistive device to the heart. In either case, the primary case of thrombosis, namely insufficient circulation of blood, particularly in the calf, may be significantly reduced. It will be appreciated that this peristaltic wave pump can be applied to many other applications other than to the human body.

Figure 43:
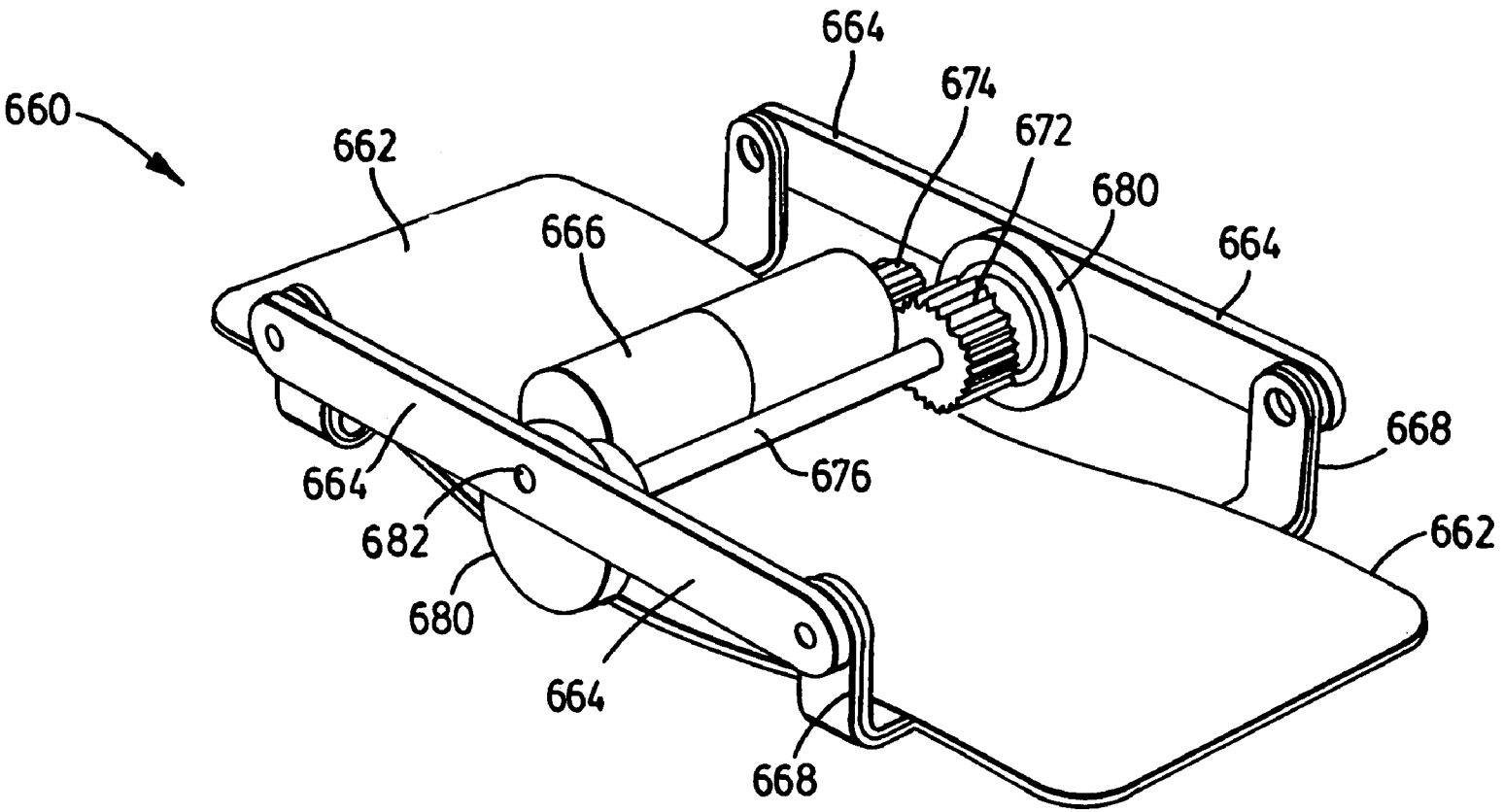
FIG. 43 is a perspective view of another wave generating apparatus for use as a peristaltic pump which can be worn by a person similar to the device shown in FIGS. 38 and 39.

Referring to FIG. 43, another embodiment of a wearable peristaltic pump is shown generally at 660. Pump 660 includes a gear-reduced motor 666 with an output drive pinion gear 674 engaging a gear 672. Gear 672 is integrally mounted to a two-sided crankshaft 676 pivotally anchored to planar wave sheet 662 and rotationally driving two discs 680 having pins 682 engaged with beams 664 thereby oscillating beams 664. Beams 664 engage two spaced apart link members 668 attached to planar wave sheet 662. Rotation of pinion gear 674 driven by gear motor 666 causes rotation of gear 672 and crankshaft 676 to cause oscillatory movement of beams 676. Oscillation of beams 676 engaging spaced apart link members 668 deforms the sheet 662 into a traveling wave.

An advantage of using the two sided crank 676 for engaging the two beams instead of one is that the loads are evenly distributed on both sides of the mechanism resulting in a stronger and more durable assembly.

The wearable peristaltic pump 660 may be strapped to a users limb such as their lower leg using straps attached thereto (not shown). Battery power supplied by 2 AA batteries (not shown) powers the efficient gear reduced DC motor 666 which turns the two-sided crank 676, and through the attached linkage mechanism producing the wave motion in flexible sheet 662, thereby producing a traveling wave that begins at the bottom of the calf near the ankle and squeezes the soft tissues in the direction of the knee with each rotation of the crank resulting in one complete cycle of wave movement. The system as shown has a wave amplitude of 0.9 cm, 7 cm wide, travelling at approximately 200 cm/minute resulting in a volumetric displacement of 0.8 litres/minute in the calf. The weight of the mechanism, inclusive of batteries is less than 300 grams and is small enough to be worn inconspicuously under loose fitting pants. Power consumption is under 1 watt so that two 1.5 Volt AA batteries with a 2 amp hr capacity can power the device continuously for 6 hrs or longer.

Figure 39A:
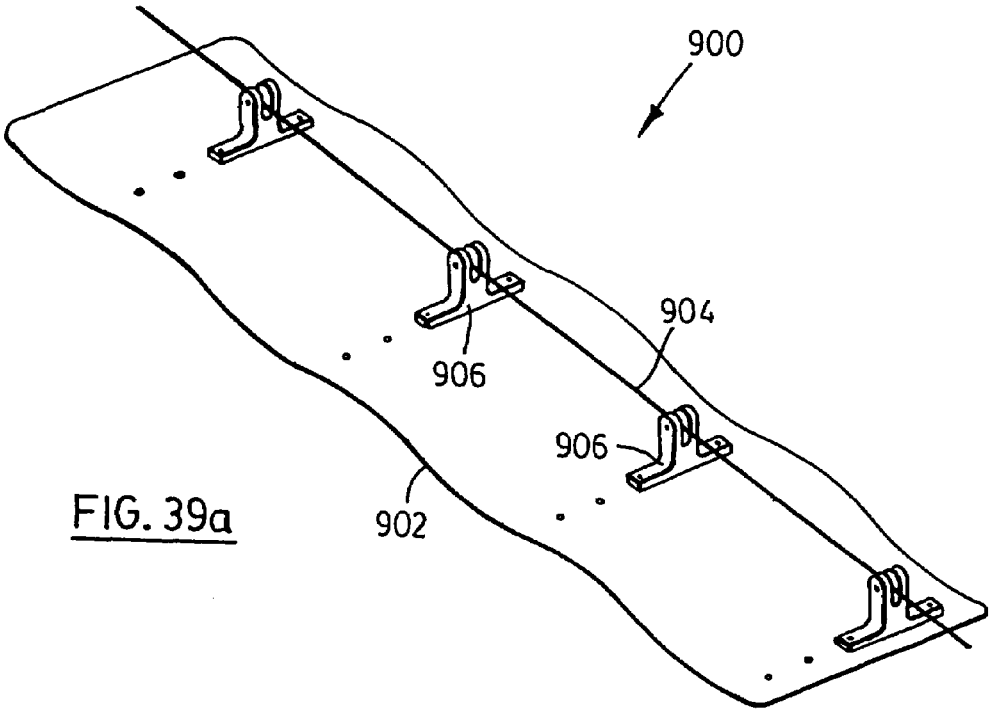
FIG. 39*a* is a perspective view of a part of another embodiment of a wave generating device constructed in accordance with the present invention.
Figure 39B:
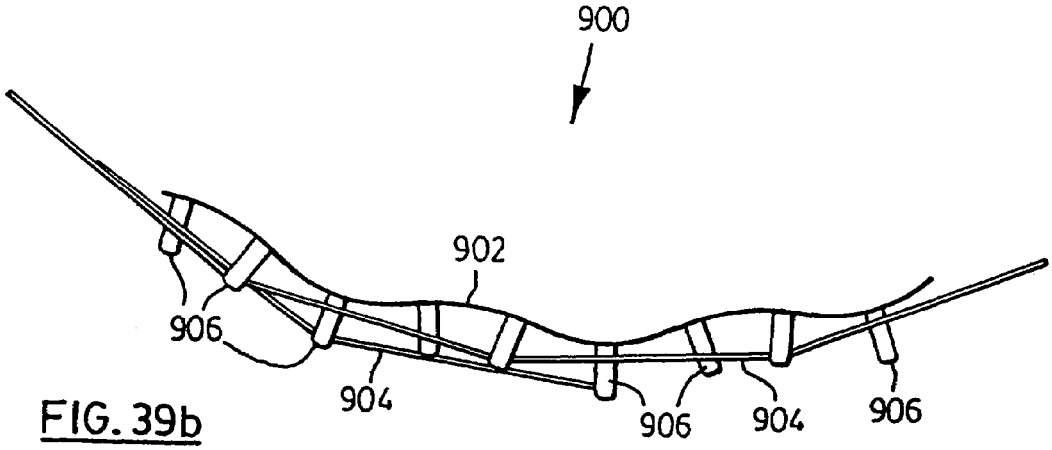
FIG. 39*b* is a side view of the device of FIG. 39*a;*
Figure 39C:
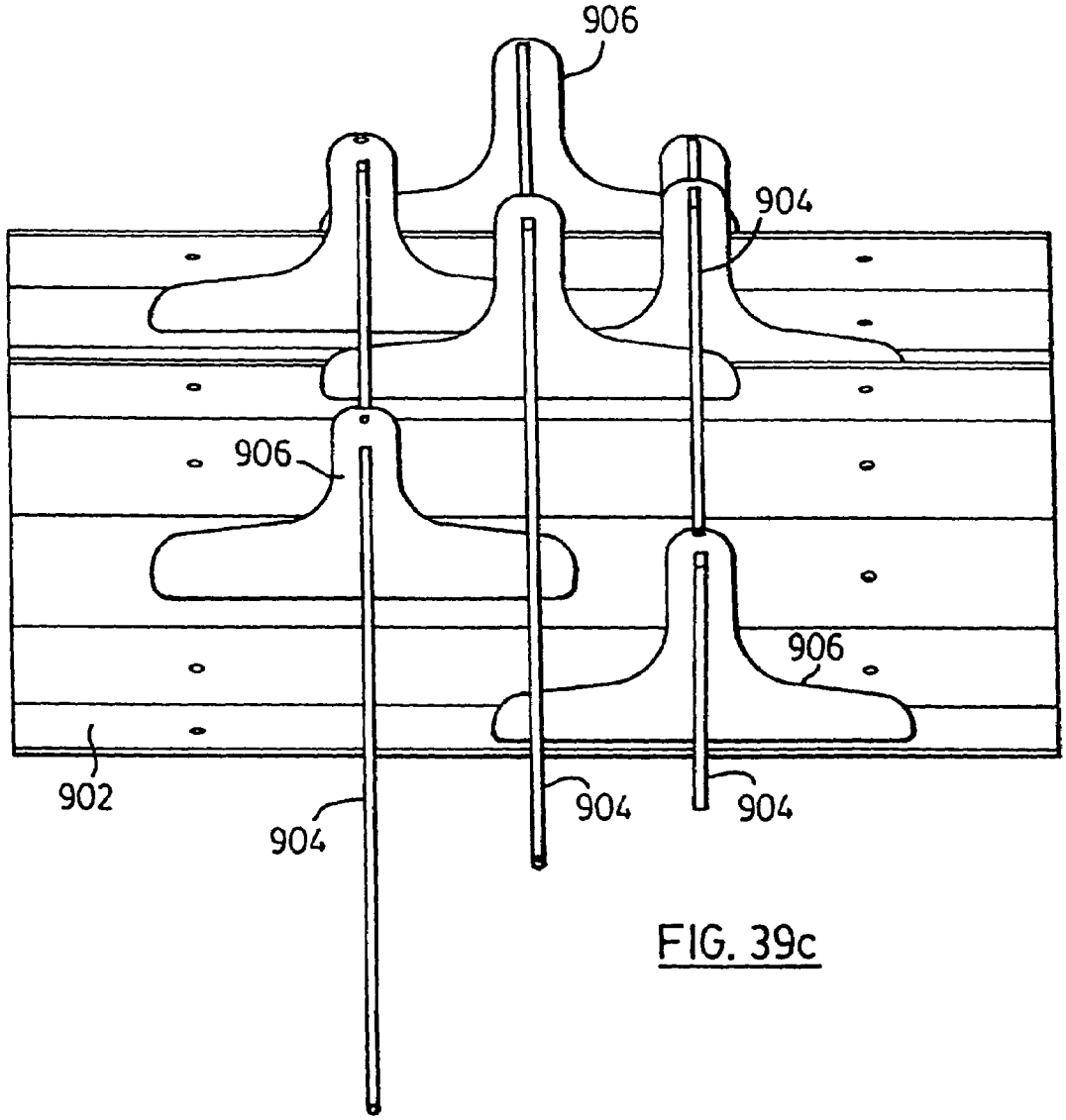
FIG. 39*c* is a detailed view of the device of FIG. 39*a;*

FIGS. 39*a* and 39*b* show an embodiment of an apparatus at 900 for generating wave motion which allows the shape of the flexible sheet 902 to be adjusted. Wires 904 are attached to rigid link members 906 projecting from the surface of sheet 902. Wires 904 effectively act as a rigid beam (in tension) only in the drive direction and is flexible in the two planes normal to the wave movement. Adjustment of the wire lengths at the point of attachment to the ribs changes the shape of the wave. In this way the wave surface can be molded to the shape of the seated occupant by manually or automatically adjusting the wire lengths to reshape the wave to the desired ergonomic profile. In this embodiment a minimum of three wires is used to impart a traveling wave, see FIG. 39*c*. For example, the generally planar shape of FIG. 39*a* has been modified to that shown in FIG. 39*b* by increasing the length of the wires 904 between links 906.

The drive means for these wires can be any rotating crankshaft with crank attachment positions in phase with the wire driven rib attachments.

Figure 34C:
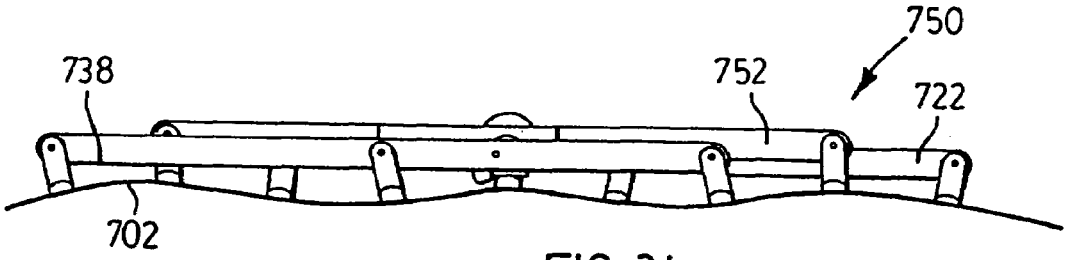
FIG. 34*c* is a side view of the device of FIG. 34*b;*
Figure 39D:
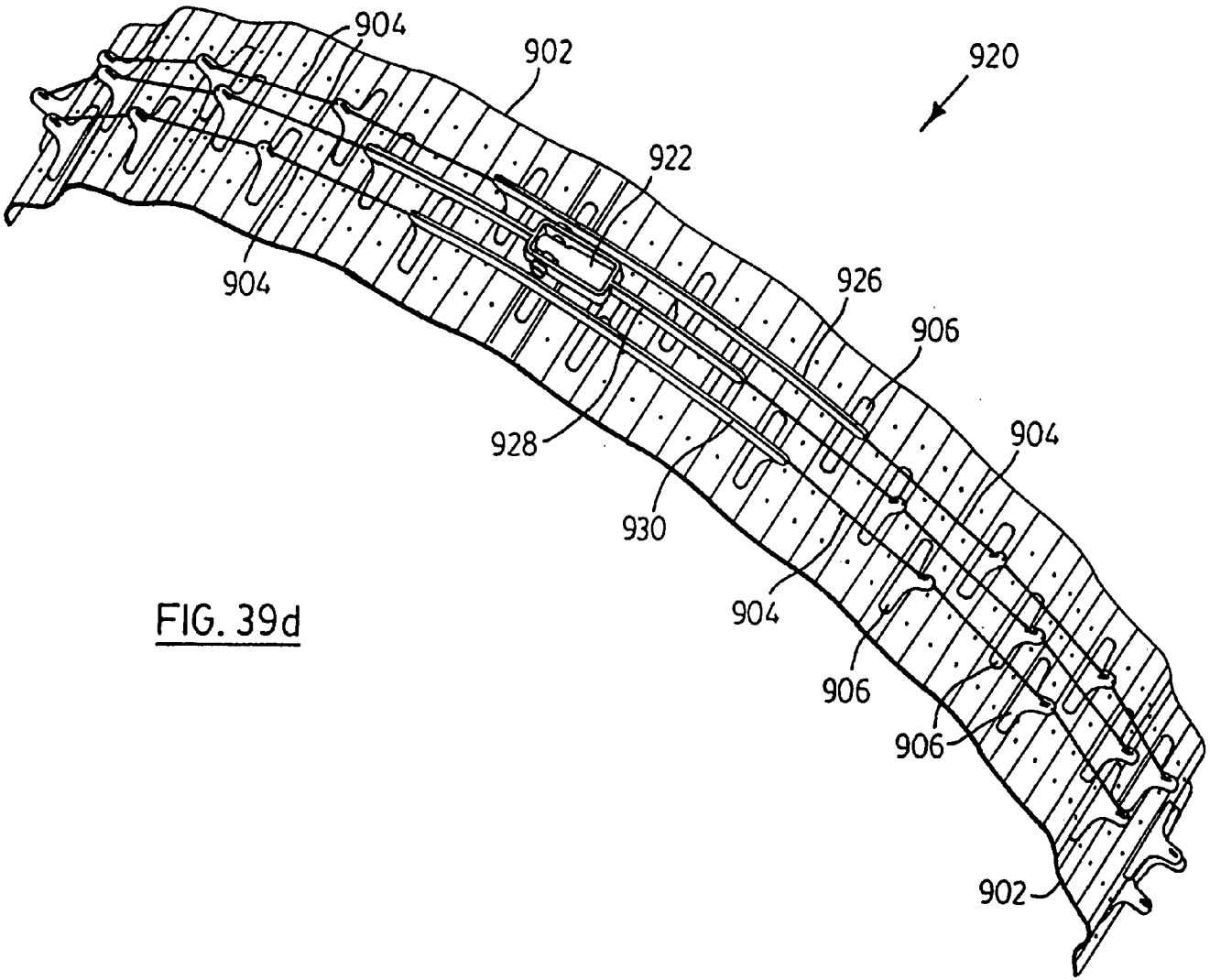
FIG. 39*d* is a complete perspective view of the device of FIG. 39*a;*

Alternatively these wires may be directly attached to a multi-beam wave device where the wires are flexible extensions of each beam allowing propagation of waves through adjustable wave trajectories. Referring to FIG. 39*d,* a wire driven wave assembly 920 includes flexible planar sheet 902 driven by gear motor 922 connected to three curved beams 926, 928 and 930 similar to the three beam embodiment 750 shown in FIGS. 34*a* to 34*c*. Wires or cables 904 are connected to the ends of each of the curved beams and in effect the wires are flexible extensions of these beams. While in this embodiment the beams 926, 928 and 930 are driven with a gear motor 922 driven crankshaft, those skilled in the art will appreciate that the wires 904 may be driven directly by the crankshaft. This embodiment can be combined with any multi-beam (3 or more beams) system to provide wave movement through flexible paths, as is required, for example, in a mattress for an adjustable hospital bed, or for a chair with an adjustable ergonomic profile.

In general, when flexible beams (wires, cables, flexible flat beams) are used, three (or more) flexible beams (wires, cables) need to be connected to a crank assembly with three (or more) crank positions driven in phase or three (or more) crank positions driving three (or more) beams to which each wire or cable is attached. Alternatively, when at least three beams are used, each beam may be flexible in one or both planes perpendicular to the wave motion. A wire or cable, rigid along its length, is effectively a beam with flexibility in the two planes perpendicular to the travel direction whereas a flat beam is flexible in one direction. A beam may therefore consist of rigid and flexible portions. The gear motor and crank may be positioned as shown in FIG. 39*d* on the back of the flexible sheet or alternatively they may be positioned at one of the ends of the sheet. Furthermore, because each point on a beam moves exactly the same way as the crank attachment point, attaching a wire to a beam is effectively the same as attaching the wire directly to a crank pin.

Universal Crank Coupling

Figure 41:
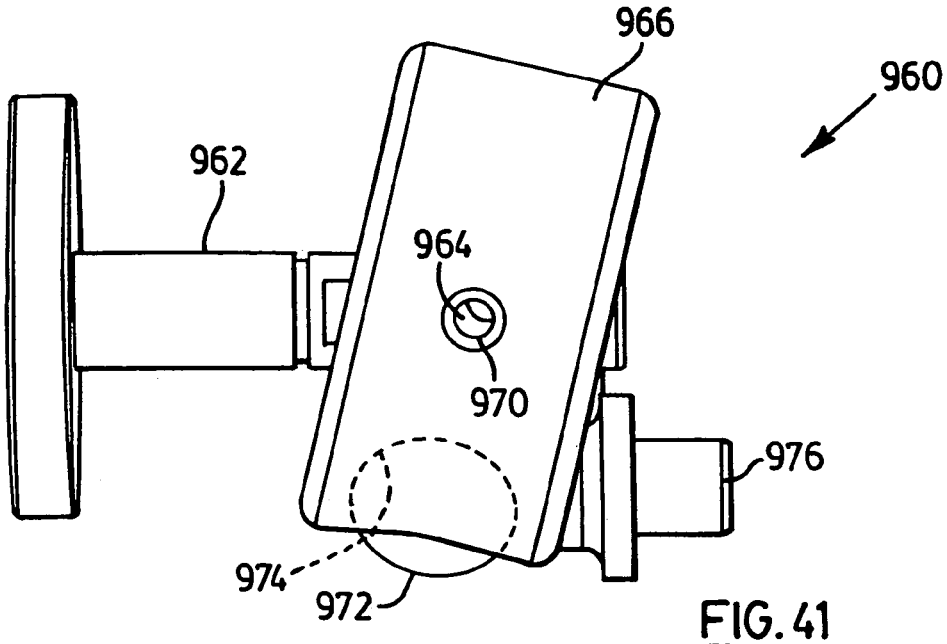
FIG. 41 is a side view of a crank coupling for use in the mechanisms of for example FIGS. 32, 33, 34 and 45.

FIG. 41 shows a perspective view of a universal crank coupling 960 which includes a rotating shaft 962 with transverse pivot hole 964 and a crank body 966 pivotally connected to shaft 962 by means of a connecting pin 970. Crank body 966 includes a ball socket 974 which engages and restrains a ball trunion 972 which in turn is rigidly connected to a beam 976. The beam 976 being rigidly connected to the ball trunion 972 is and driven in a circular path relative to the rotating shaft 962.

Figure 42:
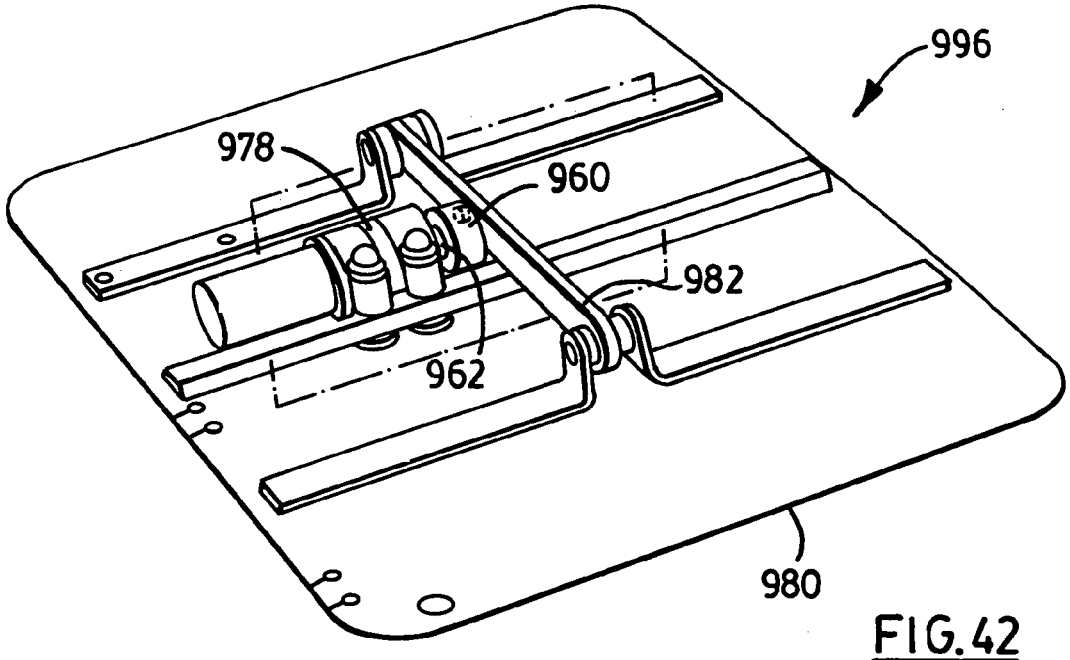
FIG. 42 is a perspective view of a wave generating apparatus incorporating the crank coupling of FIG. 41.

This crank coupling 960 is used in a wave assembly such as that shown generally at 990 in FIG. 42 which shows a motor 978 which rotates drive shaft 962 (FIG. 41) which in turn rotates crank body 966 so that shaft 976 is rotated and since it is connected to beam 982 therefore beam 982 undergoes oscillatory movement which produces waves in planar flexible sheet 980 in the same way as described in the embodiments discussed above.

The purpose of the assembly 960 is to provide a universal crank assembly so that only the force of rotation (oscillation) is transmitted from the driving rotating shaft 962 to the crank pin 970. Free movement of the crank pin 970 along the axis of the rotating shaft 962 is allowed through pivoting of the crank body 966 on the axis of the connecting pin and sliding of the ball trunion 972 within its socket 974. Misalignment in any dimension of the crank pin 970 is allowed through movement of the ball trunion 972 within the socket 974 on the crank body 966.

Crank coupling 960 has significant advantages in wave assembly 990 where external forces acting on the wave sheet distort the planar surface of the wave and cause misalignment of the beams relative to the driven axis of the shaft, also supported by the wave sheet. These distortions are freely accommodated without transmitting forces through to the shaft, thereby preventing excessive loads that might otherwise damage the assembly.

Creating Static Contours to Shape a Wave

It will be appreciated by those skilled in the art that in all of the embodiments of the mechanisms for generating wave motion, the traveling waves can be stopped at any point in its travel to freeze the wave shape. Similarly a plurality of separately driven wave segments mounted on a common wave surface can be frozen at any point in the respective wave travels to provide for an adjustable surface that can accommodate a diverse range of contours, including but not limited to adjustable lumbar surfaces, back or seat supports. The traveling waves may be frozen into the flexible planar sheet simply by using any one of several speed control means. For example, an "on-off" switch connected to the motor driving the crank assembly in the various embodiments of the wave generating devices can be used to freeze the waves at a pre-selected point. Another type of control involves the motor being connected to a microprocessor controller for varying the velocity of the waves from zero (frozen waveform) to a pre-selected upper speed suitable for the application of the device. Alternatively the motor may be a stepper type motor whose angle of rotation can be precisely controlled and stopped at precise angles to freeze the waveform in an exact position.

Combination Air Flotation and Wave

There are a variety of advantages to the use of inflatable sleeves to act as a covering or support of a wave surface and an additive advantage in combining the two. Air sleeves can operate at a variety of inflation pressures to control support point pressure. Low loss air systems also allow for some air circulation, temperature and humidity control of the support surface. What air is not good for is dynamically changing pressure to affect movement of the occupant since this requires considerable air flow, compressor noise and power consumption. The wave mechanism accomplishes this task much more effectively. Combining the two technologies takes advantage of each technology for its unique benefits.

Wave Support Structures

When a wave is pivotally supported at any two points on the flexible wave surface spaced ½ wavelength apart, then the support will rock back and forth around a stationary point which may be pivotally connected to an external frame. This is because any point of the wave surface spaced ½ wavelength from another is opposite in phase and equally displaced from the neutral axis. This feature is useful for building support structures for wave surfaces that are isolated from the oscillations of the wave movement.

Figure 44A:
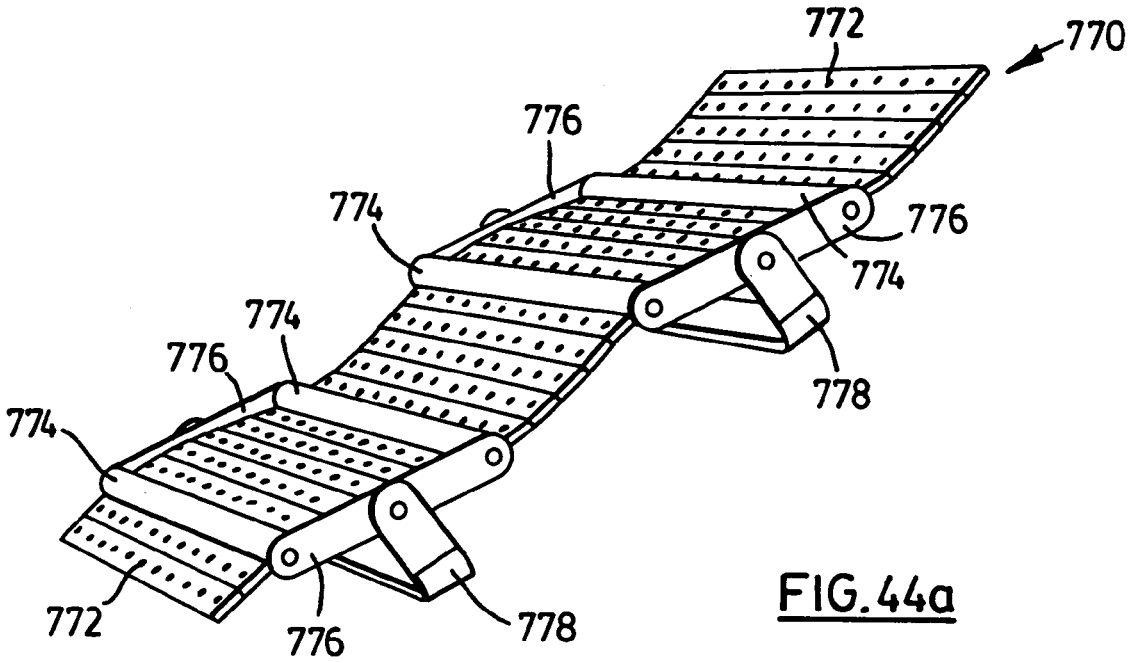
FIG. 44*a* shows a perspective view of a supported flexible wave surface.

FIG. 44*a* shows a wave generating device at 770 which includes a flexible wave sheet 772 having four tubular ribs 774 held onto the wave sheet 772 spaced ½ wavelength from each other. Four support brackets 776 each pivotally connected to the ends of a respective pair of tubular ribs 774. Two frame brackets 778 each end of which is pivotally connected to the midpoint of each support bracket 776. The frame brackets 778 will remain stationary while the wave travels along flexible sheet 772.

Figure 44B:
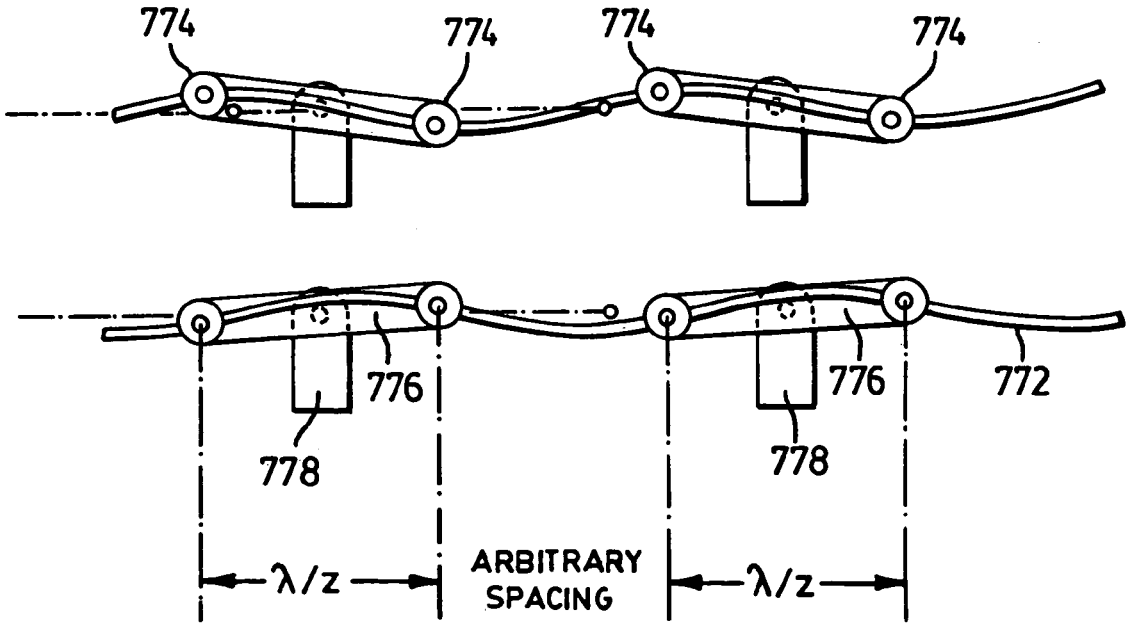
FIG. 44*b* shows two side views of the supported flexible wave surface of FIG. 44*a* in operation.

FIG. 44*b* shows a side view where it can be seen that one or more brackets 776 each pivotally connected to two points spaced ½ wavelength apart on the traveling wave surface 772 with the bracket center points (located on the neutral axis of the wave, plane 1 above) pivotally connected to support brackets 778 such that the wave oscillations are isolated from the support brackets 778. Each pair of support brackets 778 has a ½ wavelength spacing but the distance between any pair can be any dimension as shown in FIG. 44*b*.

As used herein, the terms "comprises", "comprising", "including" and "includes" are to be construed as being inclusive and open ended, and not exclusive. Specifically, when used in this specification including claims, the terms "comprises" and "comprising" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. An apparatus for generating wave motion, comprising:

a) a flexible member and at least one link member having opposed first and second end portions and being rigidly attached at said first end portion to said flexible member;

b) oscillatory drive means operably connected to an inertial anchor, said oscillatory drive means including a crank assembly, and said at least one link member being attached to said crank assembly at said second end portion so that when said oscillatory drive means is engaged said second end portion undergoes oscillatory motion to produce transverse wave motion along said flexible member; and c) the oscillatory drive means including control means for controlling a velocity of the transverse wave motion between a pre-selected upper velocity and zero velocity in which traveling waves produced by the transverse wave motion can be stopped at any point to freeze a wave shape in the flexible member.

2. The apparatus according to claim 1 wherein said crank assembly includes a crank shaft which engages said inertial anchor and a crank shaft housing, said oscillatory drive means including a motor which drives said crank shaft, and wherein said link member is formed by a combination of a boss integrally formed with said crankshaft housing with said boss being attached at one end thereof to said flexible member.

3. The apparatus according to claim 1 wherein said crank assembly includes a crank shaft, and wherein said oscillatory drive means includes a motor which drives said crank shaft and a motor housing, said motor housing being rigidly connected to said inertial anchor, wherein said crank assembly is connected to said second end portion of the at least one link member.

4. The apparatus according to claim 1 wherein said at least one link member is at least two link members each having opposed first and second end portions, the at least two link members being spaced apart a first pre-selected distance from each other and each being rigidly attached at their respective first end portions to said flexible member, and including at least one elongate beam, said at least two link members being pivotally attached to said at least one elongate beam, and said at least one elongate beam being attached to said crank assembly, for imparting oscillatory motion to the at least one elongate beam so that when the oscillatory drive means is engaged the at least one elongate beam undergoes oscillatory motion which produces transverse waves along said flexible member.

5. The apparatus according to claim 1 including a support structure, and including securing means pivotally connected to two points spaced one half of a wavelength apart on the flexible member, the securing means being pivotally connected to the support structure such that the transverse waves are isolated from the support structure.

6. An apparatus for generating wave motion, comprising:

a) a flexible member;

b) oscillatory drive means attached to said flexible member, said oscillatory drive means including a motor and a motor shaft having a longitudinal axis attached to the motor which is rotated by the motor, and a crank assembly connected to the motor shaft;

c) at least two link members each having opposed first and second end portions, the at least two link members being spaced apart a first preselected distance from each other and each being rigidly attached at their respective first end portions to said flexible member; and d) at least one elongate beam, said at least two link members being pivotally attached to said at least one elongate beam, the crank assembly including a crank housing pivotally connected to the motor shaft, the crank housing including a ball socket, a ball trunion including a trunion shaft with a ball portion at one end of the trunion shaft, the ball portion of the ball trunion being located in the ball socket and the other end of the trunion shaft being rigidly attached to the at least one elongate beam so that when the motor shaft is rotated by the motor the trunion shaft undergoes rotation in a circular path about the longitudinal axis thereby causing the at least one elongate beam to undergo oscillatory motion which produces transverse waves along said flexible member.

7. The apparatus according to claim 6 wherein the oscillatory drive means includes control means for controlling a velocity of the transverse waves between a pre-selected upper velocity and zero velocity in which traveling waves produced by the transverse wave can be stopped at any point to freeze a wave shape in the flexible member.

8. The apparatus according to claim 6 wherein said oscillatory drive means is attached to said flexible member between said at least two link members, and wherein said at least one elongate beam is an elongate rigid beam.

9. The apparatus according to claim 8 wherein said flexible member is a substantially planar flexible member.

10. The apparatus according to claim 9 including two elongate ribs spaced apart said first pre-selected distance from each other and being attached to said planar flexible member and extending in a direction across said planar flexible member perpendicular to a direction of travel of said transverse traveling waves along said planar flexible member, and wherein said link members are rigidly attached at their first end portions to said ribs.

11. The apparatus according to claim 10 including a third elongate rib attached to said planar flexible member between said two elongate ribs and extending in a direction across said planar flexible member perpendicular to a direction of travel of said transverse traveling waves along said planar flexible member, and wherein said oscillatory drive means is rigidly attached to said third elongate rib.

12. The apparatus according to claim 9 including a second elongate rigid beam pivotally connected to another two link members which are rigidly connected at first end portions thereof to said planar flexible member and spaced apart a second pre-selected distance, said crank assembly including a first crank connected to said first elongate rigid beam and a second crank connected to said second elongate rigid beam, said two cranks being offset from each other by a preselected angular displacement so that the oscillatory drive means synchronously drives said two elongate rigid beams with an effective phase between each other so that said transverse traveling waves are produced along the planar flexible member.

13. The apparatus according to claim 12 including first and second elongate ribs spaced apart said first pre-selected distance from each other and being attached to said planar flexible member, including third and fourth elongate ribs spaced apart said second pre-selected distance from each other and being attached to said planar flexible member, said four elongate ribs extending in a direction across said planar flexible member perpendicular to a direction of travel of said transverse traveling waves along said planar flexible member, and wherein each link member is rigidly attached at its first end portion to an associated elongate rib.

14. The apparatus according to claim 13 including a fifth elongate rib attached to said planar flexible member and extending in a direction across said planar flexible member perpendicular to a direction of travel of said transverse traveling waves along said planar flexible member, and wherein said oscillatory drive means is rigidly attached to said fifth elongate rib.

15. The apparatus according to claim 12 including a third elongate rigid beam located between said two elongate rigid beams and pivotally connected to another two link members which are rigidly connected to said planar flexible member and spaced apart a third pre-selected distance, said third elongate rigid beam being pivotally attached to said oscillatory drive means.

16. The apparatus according to claim 14 including a third elongate rigid beam located between said two elongate rigid beams and pivotally connected to another two link members which are rigidly connected to sixth and seventh elongate ribs attached to said planar flexible member with said sixth and seventh ribs being spaced apart a third pre-selected distance and extending in a direction across said planar flexible member perpendicular to a direction of travel of said transverse traveling waves along said planar flexible member.

17. The apparatus according to claim 12 wherein said planar flexible member is a substantially planar spring assembly.

18. The apparatus according to claim 17 wherein said planar spring assembly is attached to one of a bed frame and a chair frame.

19. The apparatus according to claim 16 wherein said planar flexible member is a substantially planar spring assembly.

20. The apparatus according to claim 19 wherein said planar spring assembly is attached to one of a bed frame and a chair frame.

21. The apparatus according to claim 6 wherein said at least one elongate beam includes at least three flexible beams that are flexible in at least one plane perpendicular to the direction of travel of said transverse waves and rigid in tension in a plane parallel to the direction of travel of said transverse waves, and wherein said at least two link members is at least six link members, and wherein said at least three flexible beams are each connected to at least two of said at least six link members, said at least three flexible beams being connected to said crank assembly, said crank assembly having at least three crank positions driven in phase so that the oscillatory drive means synchronously drives said at least three flexible beams with an effective phase between each of them so that said transverse traveling waves are produced along the planar flexible member.

22. The apparatus according to claim 21 wherein said at least three flexible beams are flexible in two planes perpendicular to the direction of travel of the transverse waves.

23. The apparatus according to claim 22 wherein said at least three flexible beams are wire cables.

24. The apparatus according to claim 23 wherein said link members include adjustment means for adjusting a length of each cable at a point of attachment of the cables to the link members for changing a static shape of the flexible member reshaping the flexible member to a desired ergonomic profile.

25. The apparatus according to claim 24 wherein said flexible member is a substantially planar flexible member.

26. The apparatus according to claim 25 wherein said planar flexible member is attached to one of a bed frame and a chair frame.

27. The apparatus according to claim 24 wherein said planar flexible member is a substantially planar spring assembly.

28. The apparatus according to claim 27 wherein said planar spring assembly is attached to one of a bed frame and a chair frame.

29. The apparatus according to claim 6 including a support structure, and including securing means pivotally connected to two points spaced one half of a wavelength apart on the flexible member, the securing means being pivotally connected to the support structure such that the transverse waves are isolated from the support structure.

30. A wave generating device for pumping bodily fluids in a person, comprising;

a) a flexible member;

b) two elongate beams and two link members connected to each of the two elongate beams, each link member having opposed first and second end portions, the two link members associated with each of the two elongate beams being pivotally attached at said second end portions to said associated elongate beam, and each link member being rigidly attached at their respective first end portions to said flexible member;

c) oscillatory drive means operably coupled to said flexible member for producing transverse wave motion in said flexible member, said oscillatory drive means including a motor coupled to a two-sided crankshaft having a crank attached to each end of the two-sided crankshaft, each crank having a pin attached thereto which engage the elongate beams so that so that when the motor rotates the two-sided crankshaft thereby rotating the two cranks the two elongate beams undergo oscillatory motion which produces transverse waves in the flexible member; and d) securing means for attaching said wave generating device to a person with said flexible member bearing against a part of a person's anatomy through which body fluids are to be pumped.

31. The wave generating device according to claim 30 wherein said motor is a gear-reduced motor having an output drive pinion gear which engages a gear mounted on the two-sided crankshaft.

32. The wave generating device according to claim 31 including a battery pack mounted on said flexible member connected to said gear-reduced motor.

33. A universal crank assembly, comprising:

a crank housing being pivotally attachable to a motor shaft which is driven by a motor, the motor shaft defining a longitudinal input axis about which the motor shaft rotates, the crank housing including a ball socket; and a ball trunion including a trunion shaft defining an output axis and having a ball portion at one end of the trunion shaft, the ball portion of the ball trunion being located in the ball socket and the other end of the trunion shaft being rigidly attachable to a member which is to be rotated in a circular path so that when the motor shaft is rotated by the motor the trunion shaft undergoes rotation in a circular path about the longitudinal axis thereby causing the member to which the trunion shaft is rigidly attached undergoes oscillatory motion in a circular path, and wherein the ball trunion and ball socket provide compensation when the input and output axes are non-aligned.

* * * * *